US010380859B2

(12) United States Patent
Byun

(10) Patent No.: US 10,380,859 B2
(45) Date of Patent: Aug. 13, 2019

(54) METHOD FOR DETECTING INTRUSION

(71) Applicant: SEUNGJAE CO., LTD., Seoul (KR)

(72) Inventor: Jae Hee Byun, Seoul (KR)

(73) Assignee: SEUNGJAE CO., LTD., Seoul (KR)

( * ) Notice: Subject to any disclaimer, the term of this patent is extended or adjusted under 35 U.S.C. 154(b) by 0 days.

(21) Appl. No.: 16/200,107

(22) Filed: Nov. 26, 2018

(65) Prior Publication Data

US 2019/0164399 A1 May 30, 2019

(30) Foreign Application Priority Data

Nov. 24, 2017 (KR) ..... 10-2017-0157866

(51) Int. Cl.
*G08B 13/18* (2006.01)
*G08B 13/24* (2006.01)
(Continued)

(52) U.S. Cl.
CPC ..... *G08B 13/2491* (2013.01); *G08B 13/124* (2013.01); *G08B 13/186* (2013.01)

(58) Field of Classification Search
CPC ..... G08B 13/2491; G08B 13/186; G08B 13/124; G08B 13/19697; G08B 13/122;
(Continued)

(56) References Cited

U.S. PATENT DOCUMENTS 8,928,480 B2 * 1/2015 Iffergan ..... B63G 9/04 340/501
8,947,232 B2 * 2/2015 Strong ..... G08B 13/186 250/216
(Continued)

FOREIGN PATENT DOCUMENTS

JP 2006-005654 A 1/2006
JP 2007-018412 A 1/2007
(Continued)

*Primary Examiner* — Anh V La
(74) *Attorney, Agent, or Firm* — Novick, Kim & Lee, PLLC; Song Ho Lee

(57) ABSTRACT

An intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a laser diode temperature measuring unit measuring a temperature of the laser diode, includes designating, by the intrusion determining unit, a temperature of the laser diode at a first point in time as a first temperature and setting, to a reference waveform, a waveform of a first reflected optical signal caused by an input optical signal input by the laser diode at the first point in time, designating, by the intrusion determining unit, a temperature of the laser diode at a second point in time after the first point in time as a second temperature and determining whether the second temperature is within an allowable range with respect to the first temperature, and when it is determined that the second temperature exceeds the allowable range, resetting, by the intrusion determining unit, to the reference waveform, a waveform of a second reflected optical signal caused by an input optical signal input by the laser diode at the second point in time.

3 Claims, 13 Drawing Sheets

(51) Int. Cl.
*G08B 13/186* (2006.01)
*G08B 13/12* (2006.01)

(58) Field of Classification Search
CPC ..... G08B 13/187; G01S 17/026; G01S 7/484; H04B 10/0791; G02B 6/29347; G02B 6/4432; G02B 6/4494; G01M 11/39; B63G 9/04; F41H 11/05; G01D 5/35322; G01H 9/004
USPC ..... 340/555, 541, 540, 556, 557, 564, 565; 398/21; 702/69; 385/13
See application file for complete search history.

(56) References Cited

U.S. PATENT DOCUMENTS

| | | | | |
|---|---|---|---|---|
| 9,356,691 | B2 * | 5/2016 | Johnson | H04B 10/0791 |
| 2007/0194915 | A1 * | 8/2007 | Chun | G08B 13/124 340/541 |

FOREIGN PATENT DOCUMENTS

| | | | |
|---|---|---|---|
| JP | 2012-169768 | A | 9/2012 |
| KR | 10-0217714 | B1 | 9/1999 |
| KR | 10-1106458 | B1 | 1/2012 |
| KR | 10-2016-0148422 | A | 12/2016 |

* cited by examiner

METHOD FOR DETECTING INTRUSION

CROSS-REFERENCE TO RELATED APPLICATION(S)

The present application claims priority to Korean patent application No. 10-2017-0157866 filed on Nov. 24, 2017, the entire content of which is hereby incorporated by reference.

BACKGROUND OF THE INVENTION

Field of the Invention

The present disclosure relates to a method for detecting an intrusion, and more particularly, to an intrusion detecting method using an intrusion detecting system using an optical fiber line.

Description of the Related Art

Security fences are installed in facilities and areas requiring security in many cases. Surveillance personnel may also be deployed to monitor an intrusion into the security fences. However, surveillance by surveillance personnel incurs high maintenance cost and has low monitoring accuracy.

In recent years, monitoring methods using CCTVs have widely been used. With this method, input workforce may be reduced but captured images must be directly monitored by a person. In addition, in case where a surveillance area is so large as to be several kilometers or greater, a large number of camera devices must be installed, resulting in a high installation and maintenance cost of the devices.

Further, in recent years, a monitoring method using an RF scheme has also been used. In the monitoring method using the RF scheme, a transmission line is installed in a security fence and an electrical RF signal is applied to the transmission line. If an intruder passes through or damages the transmission line, the RF signal may be changed, thus automatically detecting an intrusion. However, this method has a disadvantage in that a location where an intrusion occurs is not accurately specified.

An intrusion monitoring method using an optical fiber line may solve this problem. The intrusion monitoring method using optical fiber may monitor a large area, automatically generate an intrusion alarm, and specify and recognize a location where an intrusion occurs.

SUMMARY

The intrusion monitoring method using an optical fiber line has the advantages mentioned above but has a problem in that an intrusion may be erroneously detected due to a change in an internal or external environment. In detail, an intrusion may be erroneously detected due to an influence of temperature, wind, and the like.

An aspect of the present disclosure provides an intrusion detecting method capable of minimizing erroneous detection that may occur due to a change in environment of an intrusion detecting system.

Another aspect of the present disclosure provides an intrusion detecting method capable of increasing accuracy of an intrusion detection in consideration of a change in temperature of a laser diode and a photodiode of an intrusion detecting system.

Another aspect of the present disclosure provides an intrusion detecting method capable of enhancing accuracy of intrusion detection in consideration of environmental variables that affect an optical fiber line.

According to an aspect of the present disclosure, an intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a laser diode temperature measuring unit measuring a temperature of the laser diode, including: designating, by the intrusion determining unit, a temperature of the laser diode at a first point in time as a first temperature and setting, to a reference waveform, a waveform of a first reflected optical signal caused by an input optical signal input by the laser diode at the first point in time; designating, by the intrusion determining unit, a temperature of the laser diode at a second point in time after the first point in time as a second temperature and determining whether the second temperature is within an allowable range with respect to the first temperature; and when it is determined that the second temperature exceeds the allowable range, resetting, by the intrusion determining unit, to the reference waveform, a waveform of a second reflected optical signal caused by an input optical signal input by the laser diode at the second point in time.

According to another aspect of the present disclosure, an intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a laser diode temperature measuring unit measuring a temperature of the laser diode, including: designating, by the intrusion determining unit, a temperature of the laser diode at a first point in time as a first temperature and setting, to a reference waveform, a waveform of a first reflected optical signal caused by an input optical signal input by the laser diode at the first point in time; comparing, by the intrusion determining unit, a waveform of a second reflected optical signal caused by the input optical signal input by the laser diode at a second point in time after the first point in time with the set reference waveform and determining that an intrusion has occurred; designating, by the intrusion determining unit, a temperature of the laser diode at the second point in time as a second temperature and determining whether the second temperature is within an allowable range with respect to the first temperature; when it is determined that the second temperature exceeds the allowable range, suspending, by the intrusion determining unit, the determination that an intrusion has occurred; selecting, by the intrusion determining unit, a third point in time which comes after the first point in time and comes before the second point in time and at which the temperature of the laser diode is within the allowable range with respect to the second temperature; resetting, by the intrusion determining unit, to a reference waveform, a waveform of a third reflected optical signal caused by the input optical signal input by the laser diode at the third point in time; comparing, by the intrusion determining unit, a waveform of the second reflected optical signal with the reset reference waveform to re-determine whether an intrusion has occurred; and when it is determined that an intrusion has occurred as a result of the re-determination, canceling, by the intrusion determining unit, the suspended determination, and when it is determined that an intrusion has not occurred as a result of the re-determination, canceling, by the intrusion determining unit, the determination that an intrusion has occurred.

According to another aspect of the present disclosure, an intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a photodiode temperature measuring unit measuring a temperature of the photodiode, wherein the photodiode is an avalanche photodiode, including: designating, by the intrusion determining unit, a temperature of the photodiode at a first point in time as a first temperature and setting, to a reference waveform, a waveform of a first reflected optical signal detected by the photodiode at the first point in time; designating, by the intrusion determining unit, a temperature of the photodiode at a second point in time after the first point in time as a second temperature and determining whether the second temperature is within an allowable range with respect to the first temperature; and when it is determined that the second temperature exceeds the allowable range, resetting, by the intrusion determining unit, to the reference waveform, a waveform of a second reflected optical signal detected by the photodiode at the second point in time.

According to another aspect of the present disclosure, an intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a photodiode temperature measuring unit measuring a temperature of the photodiode, wherein the photodiode is an avalanche photodiode, including: designating, by the intrusion determining unit, a temperature of the photodiode at a first point in time as a first temperature and setting, to a reference waveform, a waveform of a first reflected optical signal detected by the photodiode at the first point in time; comparing, by the intrusion determining unit, a waveform of a second reflected optical signal detected by the photodiode at a second point in time after the first point in time with the set reference waveform and determining that an intrusion has occurred; designating, by the intrusion determining unit, a temperature of the photodiode at the second point in time as a second temperature and determining whether the second temperature is within an allowable range with respect to the first temperature; when it is determined that the second temperature exceeds the allowable range, suspending, by the intrusion determining unit, the determination that an intrusion has occurred; selecting, by the intrusion determining unit, a third point in time which comes after the first point in time and comes before the second point in time and at which the temperature of the photodiode is within the allowable range with respect to the second temperature; resetting, by the intrusion determining unit, to a reference waveform, a waveform of a third reflected optical signal detected by the photodiode at the third point in time; comparing, by the intrusion determining unit, a waveform of the second reflected optical signal with the reset reference waveform to re-determine whether an intrusion has occurred; and when it is determined that an intrusion has occurred as a result of the re-determination, canceling, by the intrusion determining unit, the suspended determination, and when it is determined that an intrusion has not occurred as a result of the re-determination, canceling, by the intrusion determining unit, the determination that an intrusion has occurred.

According to another aspect of the present disclosure, an intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and an environment measuring unit measuring an environmental variable which affects the optical fiber line, including: designating, by the intrusion determining unit, an environmental variable at a first point in time as a first environmental variable and setting, to a reference waveform, a waveform detected by the photodiode at the first point in time; designating, by the intrusion determining unit, an environmental variable at a second point in time after the first point in time as a second environmental variable and determining whether the second environmental variable is within an allowable range with respect to the first environmental variable; and when it is determined that the second environmental variable exceeds the allowable range, resetting, by the intrusion determining unit, to the reference waveform, a waveform of a second reflected optical signal detected by the photodiode at the second point in time.

According to another aspect of the present disclosure, an intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and an environment measuring unit measuring an environmental variable which affects the optical fiber line, including: designating, by the intrusion determining unit, an environmental variable at a first point in time as a first environmental variable and setting, to a reference waveform, a waveform of a first reflected optical signal detected by the photodiode at the first point in time; comparing, by the intrusion determining unit, a waveform of a second reflected optical signal detected by the photodiode at a second point in time after the first point in time with the set reference waveform and determining that an intrusion has occurred; designating, by the intrusion determining unit, an environmental variable at the second point in time as a second environmental variable and determining whether the second environmental variable is within an allowable range with respect to the first environmental variable; when it is determined that the second environmental variable exceeds the allowable range, suspending, by the intrusion determining unit, the determination that an intrusion has occurred; selecting, by the intrusion determining unit, a third point in time which comes after the first point in time and comes before the second point in time and at which the environmental variable is within the allowable range with respect to the second environmental variable; resetting, by the intrusion determining unit, to a reference waveform, a waveform of a third reflected optical signal detected by the photodiode at the third point in time; comparing, by the intrusion determining unit, a waveform of the second reflected optical signal with the reset reference waveform to re-determine whether an intrusion has occurred; and when it is determined that an intrusion has occurred as a result of the re-determination, canceling, by the intrusion determining unit, the suspended determination, and when it is determined that an intrusion has not occurred as a result of the re-determination, canceling, by the intrusion determining unit, the determination that an intrusion has occurred.

The environmental variable may include any one of a direction of the wind, a wind velocity, a temperature, and illumination around the optical fiber line.

The environment measuring unit may include any one of a weather vane, an anemometer, a thermometer, and an illuminometer.

The intrusion detecting method according to the embodiments of the present disclosure may minimize erroneous detection that may occur according to a change in an environment of an intrusion detecting system.

The intrusion detecting method according to the embodiments of the present disclosure may increase accuracy of detection of an intrusion in consideration of a change in temperature of the laser diode and the photodiode of the intrusion detecting system.

The intrusion detecting method according to the embodiments of the present disclosure may increase accuracy of detection of an intrusion in consideration of an environmental variable which affects the optical fiber line.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Hereinafter, embodiments of the present disclosure will be described in detail with reference to the accompanying drawings. In describing the present disclosure, if it is determined that a detailed description of known functions and components associated with the present disclosure unnecessarily obscure the gist of the present disclosure, the detailed description thereof will be omitted. The terms used henceforth are used to appropriately express the embodiments of the present disclosure and may be altered according to a person of a related field or conventional practice. Accordingly, the terms should be defined on the basis of the entire content of this specification.

Hereinafter, a method of detecting an intrusion by reflecting a change in temperature of a laser diode will be described with reference to FIGS. 1 to 6.

First, an intrusion detecting system to which an intrusion detecting method according to an embodiment of the present disclosure is applied will be described with reference to FIGS. 1 and 2.

Figure 1:
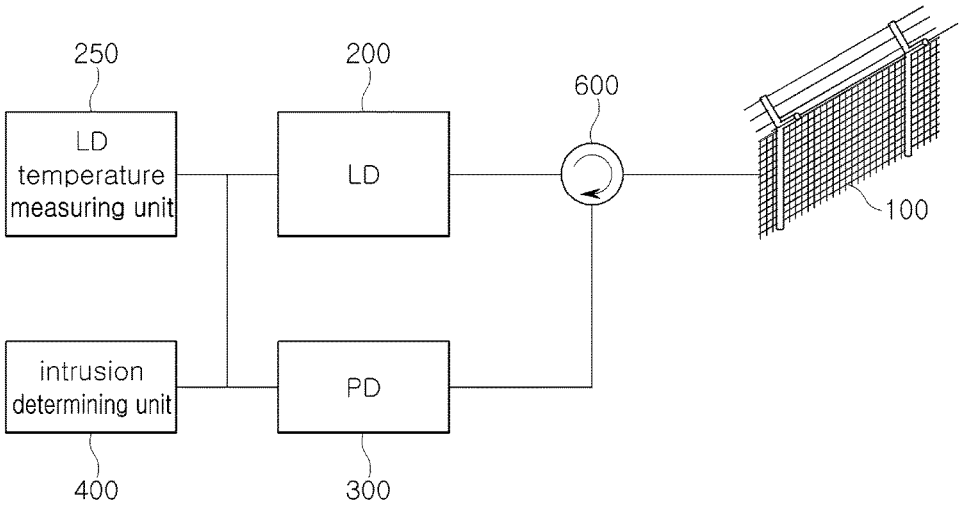
FIG. 1 is a block diagram of an intrusion detecting system to which an intrusion detecting method according to an embodiment of the present disclosure is applied.

FIG. 1 is a block diagram of an intrusion detecting system to which an intrusion detecting method according to an embodiment of the present disclosure is applied.

Referring to FIG. 1, the intrusion detecting system includes an optical fiber line 100, a laser diode (LD) 200, a photodiode (PD) 300, an intrusion determining unit 400, and an LD temperature measuring unit 250.

The intrusion detecting system may be an optical time domain reflectometer (OTDR) device which monitors the optical fiber line 100 by measuring backscattering light generated when an input optical signal is input to the optical fiber line 100.

The optical fiber line 100 is installed in an area in which an intrusion is to be detected. Specifically, the optical fiber line 100 may be formed of a line of optical fiber formed to surround an area in which an intrusion is to be detected. More specifically, the optical fiber line 100 may be coupled to an installed fence structure surrounding the area in which an intrusion is to be detected.

The optical fiber line 100 may be woven in a lattice shape and coupled to the fence structure. If there is an intrusion attempt from the outside, the optical fiber line 100 may be damaged, irritated, or impacted. Specifically, when an external force is applied to the lattice structure of the optical fiber line 100 to significantly deform a hole, bending or stretching may occur in the optical fiber line 100. In addition, in the case of an intrusion by cutting the optical fiber line 100, the optical fiber line 100 may be cut. In addition, even when an intrusion is attempted by climbing up the fence in which the optical fiber line 100 is installed or by forming a space at a lower portion of the fence, bending or stretching may occur in the optical fiber line 100. The intrusion determining unit 400 (to be described hereinafter) may detect an event of the optical fiber line 100 by comparing the input optical signal input by the laser diode 200 and the reflected optical signal detected by the photodiode 300.

At least one end of the optical fiber line 100 is connected to the laser diode 200 and the photodiode 300. Specifically, one end of the optical fiber line 100 is connected to the laser diode 200 and the photodiode 300 via an optical element 600. The optical element 600 may be an optical circulator or an optical coupler.

The optical element 600 includes a first port, a second port, and a third port. The first port of the optical element 600 is connected to an output terminal of the laser diode 200, the second port is connected to one end of the optical fiber line 100, and the third port is connected to an input terminal of the photodiode 300. Accordingly, the input optical signal generated by the laser diode 200 is input to the first port of the optical element, output to the second port, and input to the optical fiber line 100. The reflected optical signal generated in the optical fiber line 100 is input to the second port of the optical element 600, output to the third port, and input to the photodiode 300.

Although not shown, one laser diode 200 and/or one photodiode 300 may be connected to a plurality of optical fiber lines 100 using an optical switch, an optical distributor, and the like, in some cases.

The laser diode 200 generates an input optical signal. A pulse generating unit may be connected to the laser diode 200. The pulse generating unit generates a pulse signal having a specific pattern. Upon receiving the pulse signal, the laser diode 200 generates the input optical signal. The laser diode 200 is connected to one end of the optical fiber line 100 and inputs the generated input optical signal to the optical fiber line 100.

Characteristics of an optical output from the laser diode 200 are changed according to temperatures. The general laser diode 200 has characteristics that, although the same input power is applied, an output decreases as the temperature increases. Thus, a temperature adjusting unit may be provided to minimize a change in temperature of the laser diode 200. The temperature adjusting unit may further include a TEC or a heating element to actively regulate the temperature of the laser diode 200.

The laser diode (LD) temperature measuring unit 250 is a device for measuring a temperature of the laser diode 200 described above. The laser diode temperature measuring unit 250 may solve the problem according to temperature characteristics of the laser diode 200 by detecting a temperature of the laser diode 200. A specific method by which temperature data measured by the laser diode temperature measuring unit 250 increases accuracy of intrusion detection will be described in more detail hereinafter.

The photodiode 300 is a semiconductor diode which converts an optical signal into an electrical signal. When an optical signal is received in a state in which a reverse bias voltage is applied to the photodiode 300, a current is generated. Since a magnitude of the current varies according to power of the optical signal, power of the detected optical signal may be measured by analyzing the magnitude of the current.

The intrusion determining unit 400 compares a waveform of the reflected optical signal detected by the photodiode 300 with a set reference waveform to determine whether an intrusion has occurred. To this end, the intrusion determining unit 400 is connected to the photodiode 300 and receives data regarding the reflected optical signal detected by the photodiode 300. The intrusion determining unit 400 includes a storage device storing a reference waveform. Determining, by the intrusion determining unit 400, whether an intrusion has occurred will be described in detail with reference to FIG. 2 hereinafter.

Figure 2:
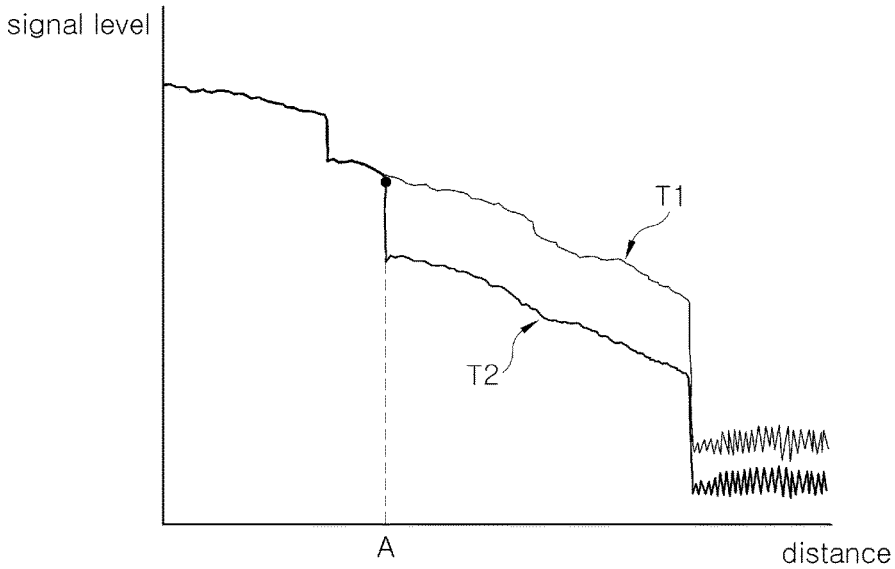
FIG. 2 is a graph illustrating a reference waveform and a waveform of a reflected optical signal.

FIG. 2 is a graph illustrating a reference waveform and a waveform of a reflected optical signal. Determining, by the intrusion determining unit 400, whether an intrusion has occurred will be described in detail.

The intrusion determining unit 400 stores the reference waveform. The reference waveform is a waveform of a reflected optical signal caused by the input optical signal input by the laser diode 200 to the optical fiber line 100 before the intrusion determining unit 400 determines whether an intrusion has occurred.

The intrusion determining unit 400 receives data of the reflected optical signal detected by the photodiode 300 and compares the data with the reference waveform. If a difference between a waveform of the reflected optical signal and the reference waveform deviates from an allowable range, the intrusion determining unit 400 determines that an intrusion has occurred. Here, an intrusion alarm, or the like, is produced. The intrusion determining unit 400 may specify a spot where a waveform of the reflected optical signal is different from the reference waveform and determine that an intrusion has occurred at the spot where the difference occurs.

Referring to FIG. 2, it is illustrated that the reflected optical signal has a magnitude smaller than the reference waveform at point A. Thus, it may be presumed that bending or elongation of the optical fiber line 100 has occurred at the point A. Upon recognizing such a difference, the intrusion determining unit 400 may determine that an intrusion has occurred.

Hereinafter, resetting of a reference waveform in the intrusion detecting method of the present disclosure will be described with reference to FIGS. 3 and 4.

Figure 3:
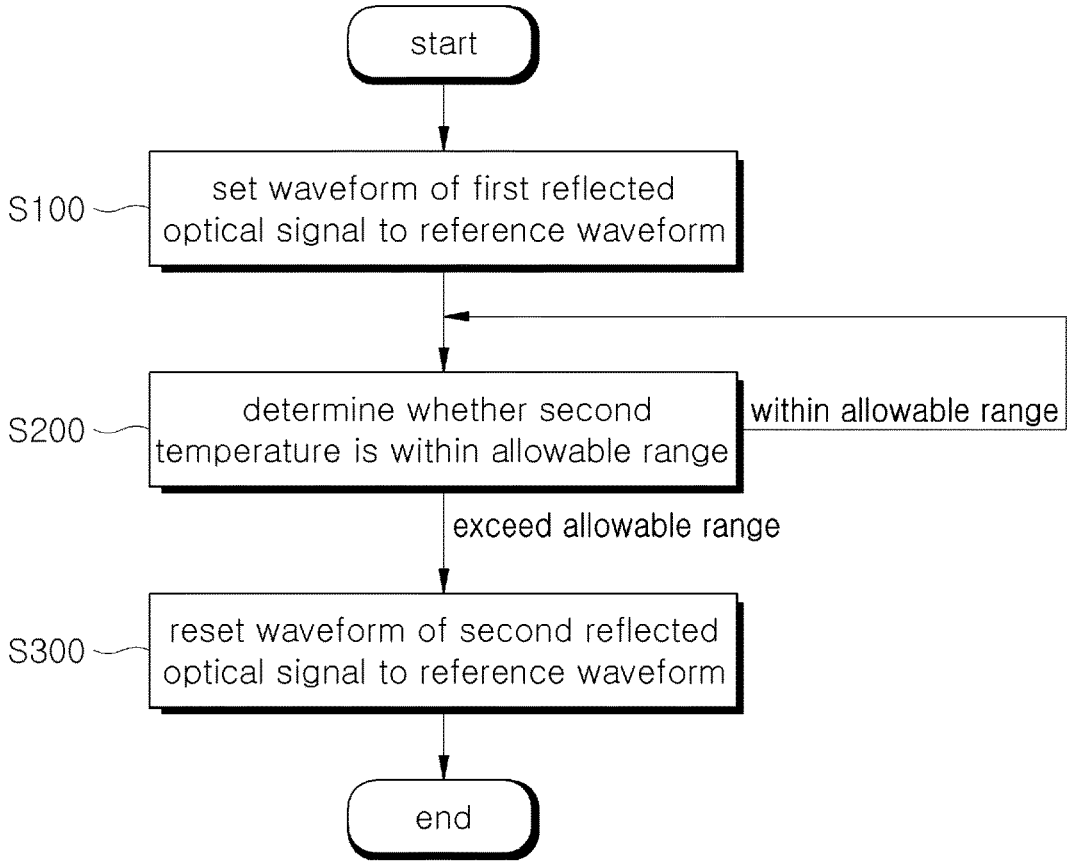
FIG. 3 is a flowchart illustrating resetting of a reference waveform.

FIG. 3 is a flowchart illustrating resetting of the reference waveform. FIG. 4 is a graph illustrating resetting of the reference waveform. Resetting of a reference waveform according to a change in temperature of the laser diode 200 will be described with reference to FIGS. 3 and 4.

Resetting of the reference waveform to be described hereinafter is intended to prevent erroneous detection of an intrusion due to a rapid changed in temperature of the laser diode 200. If the temperature of the laser diode 200 is rapidly changed, the input optical signal may also change rapidly. Here, a reflected optical signal may be changed rapidly although no intrusion, or the like, has occurred in the optical fiber line 100. In this case, the intrusion determining unit 400 may erroneously determine a change in the reflected optical signal due to such a temperature change as an intrusion.

The purpose of resetting the reference waveform to be described hereinafter is to prevent such erroneous detection. To this end, a temperature of the laser diode 200 at the time of outputting the input optical signal which has induced the reflected optical signal selected as the reference waveform and a temperature of the laser diode 200 at the present time are measured. The temperatures of the laser diode 200 are measured by the laser diode temperature measuring unit 250 described above.

Referring to FIG. 3, resetting of the reference waveform of the present disclosure includes setting a waveform of a first reflected optical signal to a reference waveform (S100), determining whether a second temperature is within an allowable range (S200), and resetting a waveform of a second reflected optical signal to a reference waveform (S300).

For the purposes of description, it is assumed that a point in time when an input optical signal which has induced an initial reference waveform is input is a first point in time and a point in time when an input optical signal which has induced a reference waveform to be reset is input is second point in time. The first point in time comes before the second point in time. Also, it is assumed that a temperature of the laser diode 200 at the first point in time is a first temperature and a temperature of the laser diode 200 at the second point in time is a second temperature.

Operation S100 of setting the waveform of the first reflected optical signal to the reference waveform will be described. The laser diode 200 inputs the input optical signal to the optical fiber line 100 at the first point in time. The first reflected optical signal T1 is caused by the input optical signal at the first point in time. The induced first reflected optical signal T1 is detected by the photodiode 300 and stored as a waveform. The waveform of the first reflected optical signal T1 is set to a reference waveform. The intrusion determining unit 400 determines whether an intrusion has occurred on the basis of the reference waveform corresponding to the first reflected optical signal T1 until the reference waveform is reset after the first point in time.

The laser diode temperature measuring unit 250 measures a temperature of the laser diode 200 at a first point in time. The laser diode temperature measuring unit 250 designates the temperature of the laser diode 200 measured at the first point in time as a first temperature and stores the same.

Operation (S200) of determining whether the second temperature is within the allowable range will be described. The second point in time comes after the first point in time. An interval between the first point in time and the second point in time may be changed to be set by the user. The laser diode temperature measuring unit 250 measures a temperature of the laser diode 200 at the second point in time. The intrusion determining unit 400 designates the temperature of the laser diode 200 measured at the second point in time as a second temperature and stores the same.

The intrusion determining unit 400 determines whether the second temperature is within the allowable range on the basis of the first temperature. Here, the allowable range is set in advance and may be changed and set by the user. The allowable range may be equal to or lower than a level at which the difference between the reflected optical signals caused by the difference between the first temperature and the second temperature is determined as an intrusion by the intrusion determining unit.

If it is determined that the second temperature exceeds the allowable range, operation (S300) of resetting the waveform of the second reflected optical signal T2 to the reference waveform is performed. If it is determined that the second temperature does not exceed the allowable range, the reference waveform is not reset and the intrusion determining unit 400 continues to determine whether an intrusion has occurred on the basis of the reference waveform corresponding to the first reflected optical signal T1.

Operation (S300) of resetting a waveform of the second reflected optical signal to a reference waveform will be described. The laser diode 200 inputs an input optical signal to the optical fiber line 100 at the second point in time. A second reflected optical signal T2 caused by the input optical signal at the second point in time is reset to a reference waveform.

Figure 4:
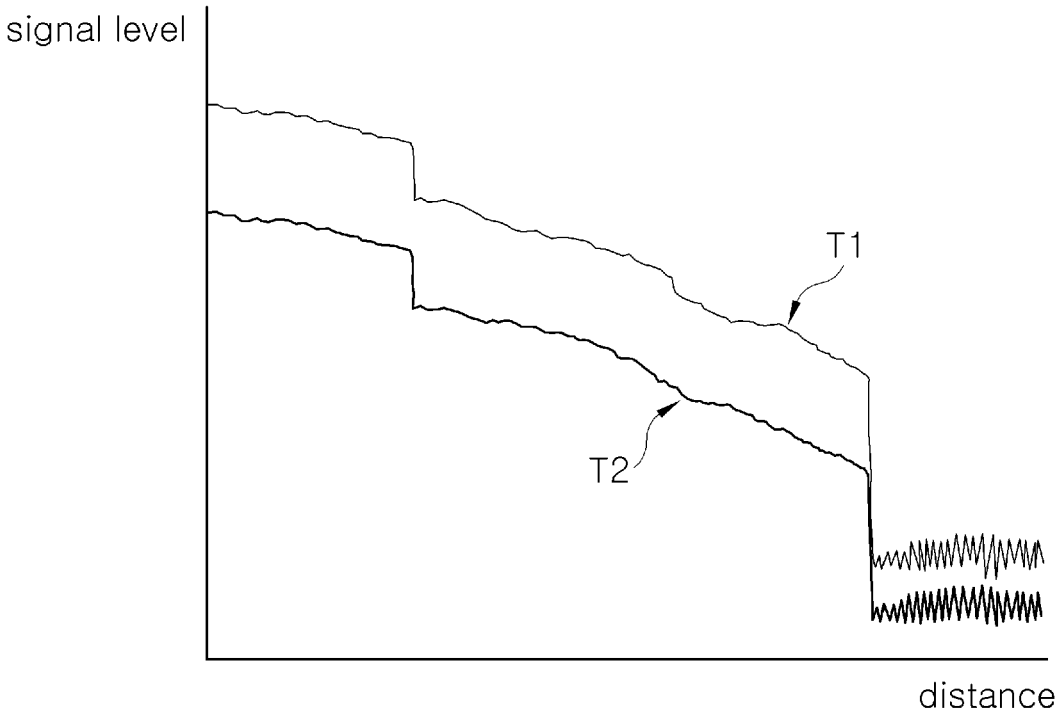
FIG. 4 is a graph illustrating resetting of a reference waveform.

In FIG. 4, an example in which the second temperature is higher than the first temperature by an allowable range or greater is illustrated. When the second temperature is higher than the first temperature, an output of the input optical signal generated by the laser diode 200 is weakened, and thus, a reflected optical signal is also weakened. Referring to FIG. 4, the second reflected optical signal T2 is illustrated to be smaller than the first reflected optical signal T1. Here, if the waveform of the second reflected optical signal is not reset to the reference waveform, the intrusion determining unit 400 may erroneously detect a change in the reflected optical signal, which is caused due to an increase in temperature of the laser diode 200 though, as the occurrence of an intrusion.

When the above-described operation is completed, the intrusion determining unit 400 newly resets the second point in time to the first point in time, and when the second point in time comes again on the basis of the newly set first point in time, the intrusion determining unit 400 repeats the above-described operations. Thus, erroneous detection of an intrusion due to a change in temperature of the laser diode 200 may be prevented.

Hereinafter, re-determination of an intrusion in the intrusion detecting method of the present disclosure will be described with reference to FIGS. 5 and 6.

Figure 5:
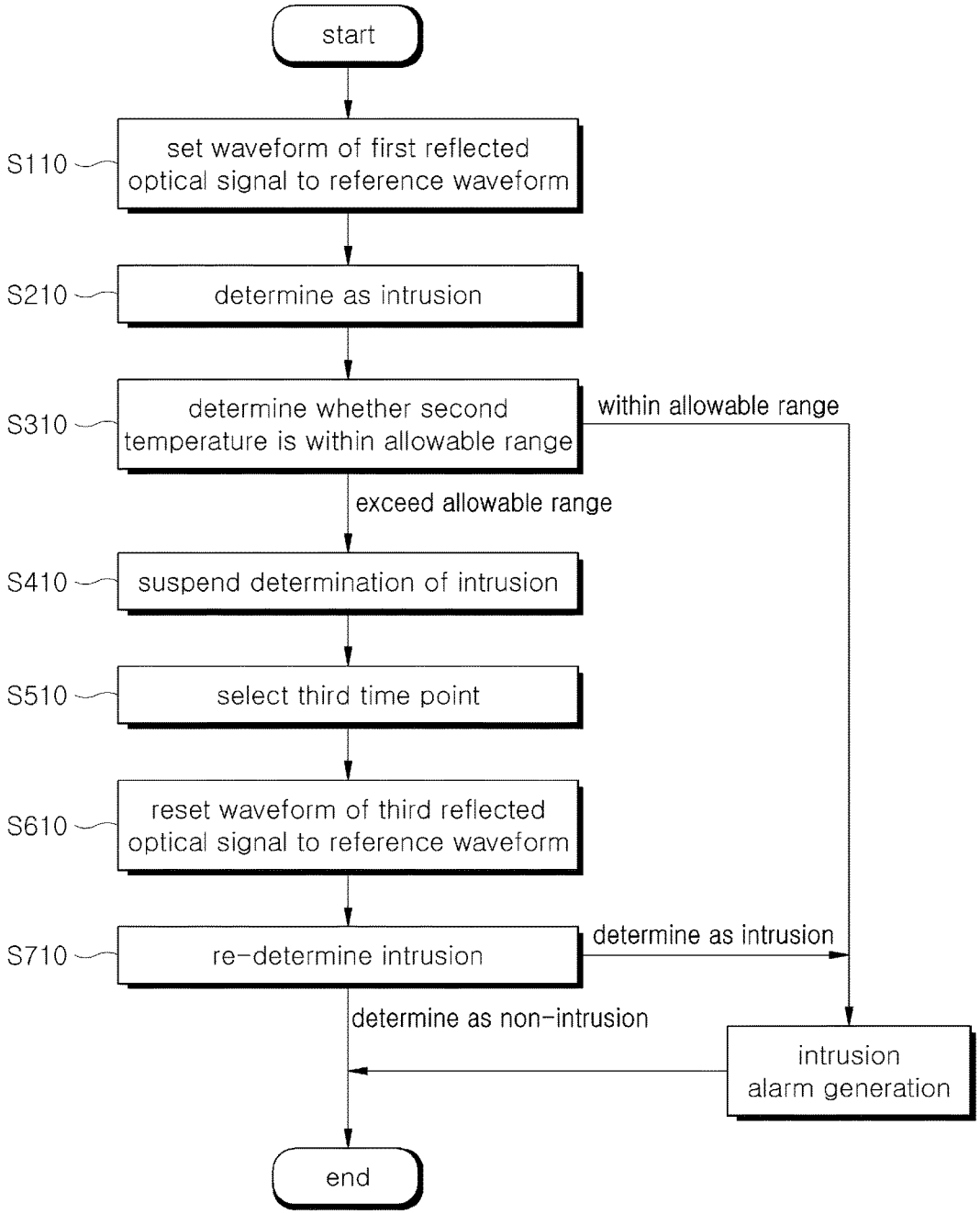
FIG. 5 is a flowchart illustrating re-determination of an intrusion.

FIG. 5 is a flowchart illustrating re-determination of an intrusion. FIG. 6 is a graph illustrating re-determination of an intrusion. Re-determination of AN intrusion in consideration of a change in temperature of the laser diode will be described with reference to FIGS. 5 and 6.

Hereinabove, resetting of the reference waveform according to a rapid change in temperature of the laser diode 200 has been described with reference to FIGS. 3 and 4. Re-determining of the intrusion described below is re-determining the intrusion, which has already been determined by the intrusion determining unit 400 on the basis of the change in the waveform due to the rapid change in temperature of the laser diode 200, in consideration of a change in temperature of the laser diode 200.

Referring to FIG. 5, re-determining of an intrusion according to the present disclosure includes setting a waveform of a first reflected optical signal to a reference waveform (S110), determining that an intrusion has occurred (S210), determining whether the second temperature is within the allowable range (S310), suspending the determination that an intrusion has occurred (S410), selecting a third point in time (S510), resetting a waveform of a third reflected optical signal to a reference waveform (S610), and re-determining whether an intrusion has occurred (S710).

For the purposes of description, a point in time when an input optical signal which induced a first reference waveform was input will be referred to as a first point in time, a point in time when an input optical signal which induced a second reflected optical signal T2 determined as an intrusion by the intrusion determining unit 400 will be referred to as a second point in time, and a point in time when an input optical signal which induced a third reflected optical signal T3 which may correspond to a reference waveform reset to re-determine an intrusion according to the second reflected optical signal T2 was input will be referred to as a third point in time. Accordingly, the first point in time is the most preceding point in time, the third point in time comes after the first point in time, and the second point in time comes after the third point in time.

Also, it is assumed that a temperature of the laser diode 200 at the first point in time is a first temperature, a temperature of the laser diode 200 at the second point in time is a second temperature, and a temperature of the laser diode 200 at the third point in time is a third temperature.

Operation (S110) of setting the waveform of the first reflected optical signal to the reference waveform will be described. The laser diode 200 inputs an input optical signal to the optical fiber line 100 at the first point in time. A first reflected optical signal T1 is caused by the input optical signal at the first point in time. The induced first reflected optical signal T1 is detected by the photodiode 300 and stored as a waveform. The waveform of the first reflected optical signal T1 is set to a reference waveform. The intrusion determining unit 400 determines whether an intrusion has occurred on the basis of the reference waveform corresponding to the first reflected optical signal T1 until the reference waveform is reset after the first point in time.

The laser diode temperature measuring unit 250 measures a temperature of the laser diode 200 at the first point in time. The intrusion determining unit 400 stores the temperature of the laser diode 200 at the first point in time as a first temperature.

Operation (S210) of determining an intrusion will be described. The laser diode 200 inputs an input optical signal to the optical fiber line 100 at the second point in time. A second reflected optical signal T2 is caused by the input optical signal at the second point in time. The induced first reflected optical signal T1 is detected by the photodiode 300 and stored as a waveform. The intrusion determining unit 400 compares the waveform of the second reflected optical signal T2 with the set reference waveform to determine whether an intrusion has occurred, and determines that an intrusion has occurred.

The second point in time comes after the first point in time. An interval between the first point in time and the second point in time may be changed and set by the user.

Figure 6:
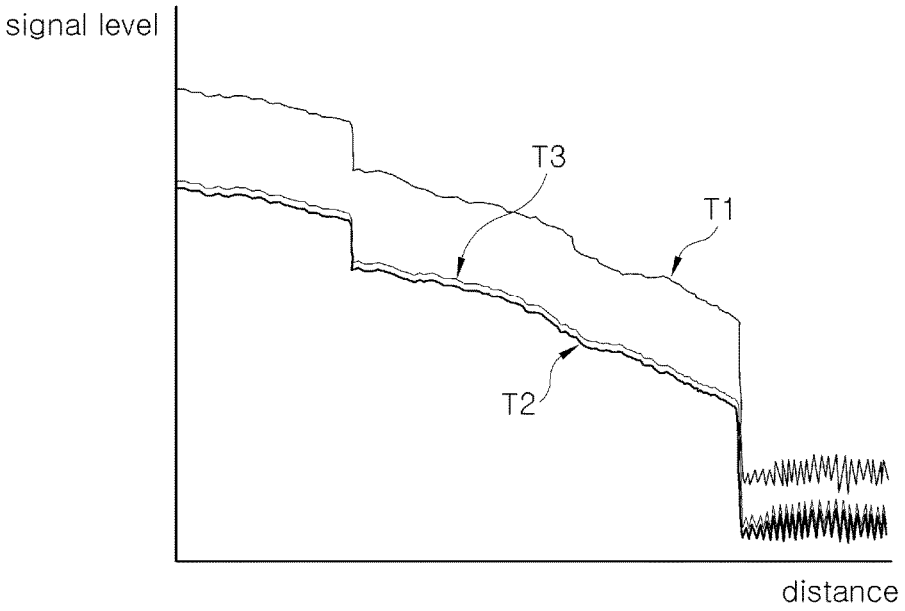
FIG. 6 is a graph illustrating re-determination of an intrusion.

In FIG. 6, an example in which the second temperature at the second point in time is higher than the first temperature by an allowable range or greater is illustrated. When the second temperature is higher than the first temperature, an output of the input optical signal generated by the laser diode 200 is weakened, and thus, the reflected optical signal is also weakened. Referring to FIG. 6, the second reflected optical signal T2 is illustrated to be smaller than the first reflected optical signal T1. As the second reflected optical signal T2 smaller than the first reflected optical signal T1 exceeds the reference for determining an intrusion, the intrusion determining unit 400 determines that an intrusion has occurred. Since the determination is based on an increase in temperature of the laser diode 200 and an intrusion has not actually occurred in the optical fiber line 100, it corresponds to erroneous detection.

Operation (S310) of determining whether the second temperature is within the allowable range will be described. The laser diode temperature measuring unit 250 measures a temperature of the laser diode 200 at the second point in time, and designates the temperature of the laser diode 200 measured at the second point in time as a second temperature and stores the same.

The intrusion determining unit 400 determines whether the second temperature is within the allowable range on the basis of the first temperature. Here, the allowable range is set in advance and may be changed to be set by the user. The allowable range may be equal to or lower than a level at which the difference between the reflected optical signals caused by the difference between the first temperature and the second temperature is determined as an intrusion by the intrusion determining unit.

If it is determined that the second temperature exceeds the allowable range, the intrusion determining unit 400 suspends the determination that an intrusion has occurred (S410), selects a third point in time (S510), resets a waveform of the third reflected optical signal to a reference waveform (S610), and re-determines whether an intrusion has occurred (S710), and the like. If, however, it is determined that the second temperature does not exceed the allowable range, the intrusion determining unit 400 confirms the determination that an intrusion has occurred, and produces intrusion alarm, or the like.

Operation (S410) of suspending the determination that an intrusion has occurred will be described. If it is determined that the second temperature exceeds the allowable range, the intrusion determining unit 400 suspends the determination that an intrusion has occurred. Accordingly, follow-up measures such as generation of an intrusion alarm, or the like, are not taken but suspended.

Operation (S510) of selecting a third point in time will be described. The third point in time is a point in time when an input optical signal inducing the third reflected optical signal T3, which becomes a new reference waveform in resetting the reference waveform, is input. The third point in time may be a previous point within a predetermined range from the second point in time. The predetermined range may be changed and set by the user. The third point in time may be closer to the second point in time than the first point in time.

The laser diode temperature measuring unit 250 measures a temperature of the laser diode 200 at the third point in time. The intrusion determining unit 400 designates the measured temperature of the laser diode 200 at the third point in time as a third temperature and stores the same. The third temperature must be within the allowable range on the basis of the second temperature. The intrusion determining unit 400 checks at least one point in time that satisfies such a condition from within a predetermined range starting from the second point in time and selects an appropriate third point in time. When the appropriate third point in time is selected, resetting a waveform of the third reflected optical signal T3 to a reference waveform is performed.

Operation (S610) of resetting the waveform of the third reflected optical signal to the reference waveform will be described. The laser diode 200 inputs an input optical signal to the optical fiber line 100 at the third point in time. The third reflected optical signal T3 caused by the input optical signal at the third point in time is reset to the reference waveform.

In FIG. 6, an example in which the third temperature is higher than the first temperature but lower than the second temperature is illustrated. The third temperature is a temperature having a smaller difference from the second temperature than the first temperature. In this case, the third reflected optical signal T3 is generated closer to the second reflected optical signal T2 than the first reflected optical signal T1. Accordingly, resetting the waveform of the third reflected optical signal to the reference waveform (S610) corresponds to resetting the reference waveform to a waveform closer to the second reflected optical signal T2.

Operation (S710) of re-determining whether an intrusion has occurred will be described. The intrusion determining unit 400 compares a waveform of the second reflected optical signal T2 with the reset reference waveform to re-determine whether an intrusion has occurred. Since the newly set reference waveform reflects correction of the error due to the rapid change in the temperature of the laser diode 200, erroneous detection of an intrusion due to the error may be prevented.

If it is determined that the waveform of the second reflected optical signal T2 still indicates an intrusion as a result of the re-determination in operation S710, the intrusion determining unit 400 cancels the previously suspended determination. Accordingly, an intrusion alarm due to an intrusion is produced. Meanwhile, if it is determined that the waveform of the second reflected optical signal T2 indicates non-intrusion as a result of re-determining whether an intrusion has occurred, the intrusion determining unit 400 cancels the previous determination that an intrusion has occurred.

If the resetting described above is not performed, the determination by the intrusion determining unit 400 that an intrusion has occurred is confirmed and an intrusion alarm is produced. Here, however, such an intrusion may not be an intrusion which actually occurred but may be an intrusion due to an increase in temperature of the laser diode 200. Thus, such erroneous detection may be prevented by the intrusion detecting method of the present disclosure.

Through the reference waveform resetting and re-evaluation method, an erroneous determination that an intrusion occurred due to a rapid change in temperature of the laser diode 200, which was already made by the intrusion determining unit 400, may be selected to correct erroneous detection thereof.

Hereinafter, a method of detecting an intrusion by reflecting a change in temperature of a photodiode will be described with reference to FIGS. 7 to 11.

First, an intrusion detecting system to which an intrusion detecting method according to another embodiment of the present disclosure is applied will be described with reference to FIG. 7.

Figure 7:
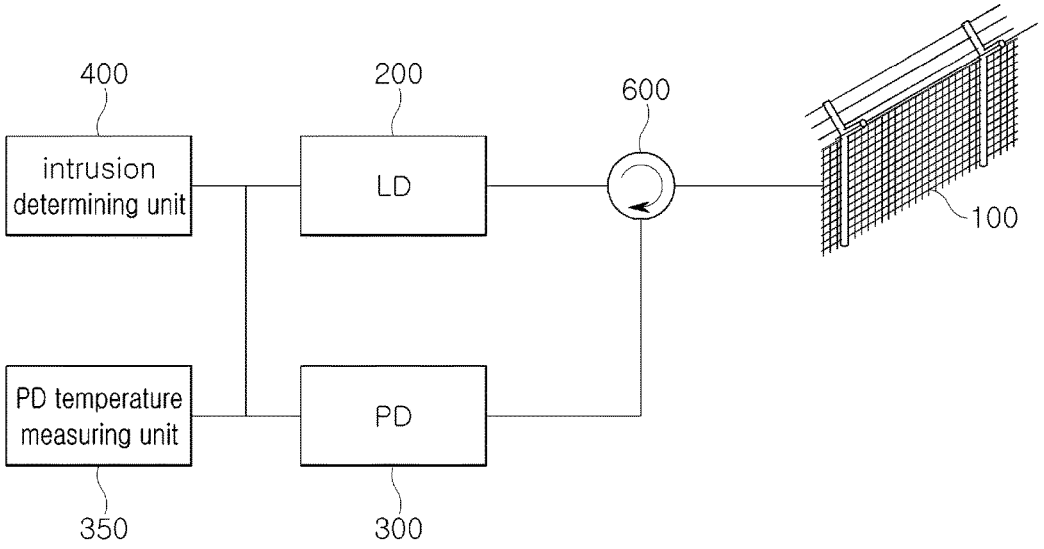
FIG. 7 is a block diagram of an intrusion detecting system to which an intrusion detecting method according to another embodiment of the present disclosure is applied.

FIG. 7 is a block diagram of an intrusion detecting system to which an intrusion detecting method according to another embodiment of the present disclosure is applied. Hereinafter, the intrusion detecting system described hereinafter is partly the same as the intrusion detecting system described above with reference to FIGS. 1 and 2. Thus, for the purposes of description, a difference from the above-described intrusion detecting system will be largely described.

Referring to FIG. 7, the intrusion detecting system includes the optical fiber line 100, the laser diode 200, the photodiode 300, the intrusion determining unit 400, and a photodiode temperature measuring unit 350.

The photodiode 300 may be an avalanche photodiode 300. The avalanche photodiode 300 has a high gain due to a light multiplying effect. The avalanche photodiode 300 is able to obtain a relatively large current due to an increase in avalanche, thus advantageously detecting a small optical signal. However, the avalanche photodiode 300 is susceptible to temperature variations. Specifically, the general avalanche photodiode 300 has a problem that sensitivity is reduced as a temperature thereof is higher.

Thus, a temperature adjusting unit may be provided to minimize a change in temperature of the photodiode 300. The temperature adjusting unit may include a thermoelectric cooler (TEC) or a heating element to actively regulate the temperature of the photodiode 300.

The photodiode temperature measuring unit 350 measures a temperature of the photodiode 300 described above. The photodiode temperature measuring unit 350 may solve a problem due to the temperature characteristics of the photodiode 300 by measuring the temperature of the photodiode 300. A specific method for increasing accuracy of intrusion detection by temperature data measured by the photodiode temperature measuring unit 350 will be described in more detail hereinafter.

Hereinafter, resetting of a reference waveform in the intrusion detecting method of the present disclosure will be described with reference to FIGS. 8 and 9.

Figure 8:
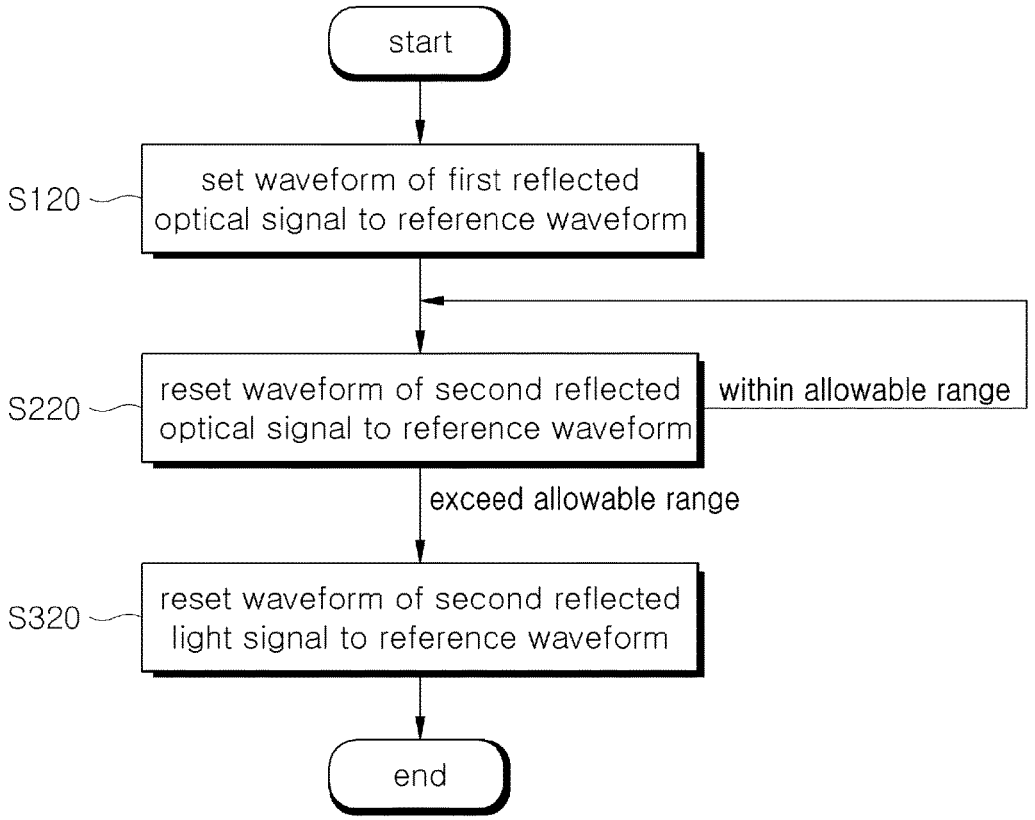
FIG. 8 is a flowchart illustrating resetting of a reference waveform.
Figure 9:
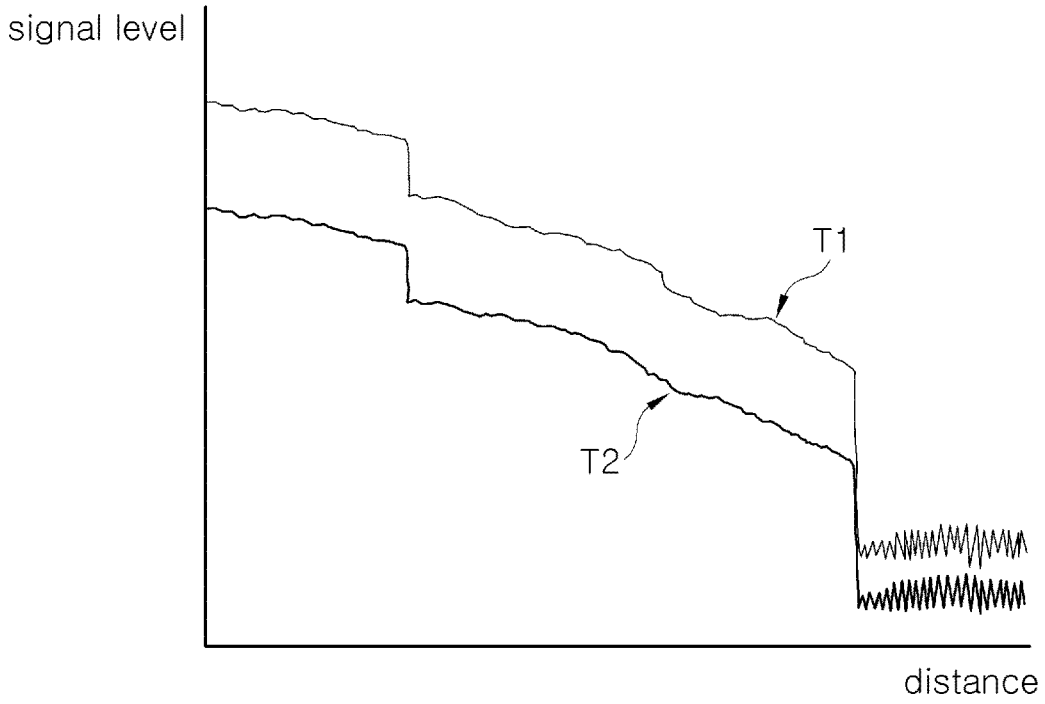
FIG. 9 is a graph illustrating resetting of a reference waveform.

FIG. 8 is a flowchart illustrating resetting of a reference waveform. FIG. 9 is a graph illustrating resetting of a reference waveform. Resetting of a reference waveform according to a change in temperature of the photodiode 300 will be described with reference to FIGS. 8 and 9.

Resetting of the reference waveform to be described hereinafter is intended to prevent erroneous detection of an intrusion due to a rapid change in temperature of the photodiode 300. If the temperature of the photodiode 300 is rapidly changed, a reflected optical signal may also change rapidly. Here, a reflected optical signal may be changed rapidly although no intrusion, or the like, has occurred in the optical fiber line 100. In this case, the intrusion determining unit 400 may erroneously determine a change in the reflected optical signal due to such a temperature change as an intrusion.

The purpose of resetting the reference waveform to be described below is to prevent such a erroneous detection. To this end, the temperature of the photodiode 300 at the point in time when the reflected optical signal selected as the reference waveform is detected and the temperature of the photodiode 300 at the current point in time are measured. The temperature measurement of the photodiode 300 is performed by the photodiode temperature measuring unit 350 described above.

Referring to FIG. 8, resetting of a reference waveform of the present disclosure includes setting a waveform of the first reflected optical signal to a reference waveform (S120), determining whether a second temperature is within an allowable range (S220), and resetting a waveform of the second reflected optical signal to a reference waveform (S320).

For the purposes of description, it is assumed that a point in time when the first reflected optical signal T1 corresponding to the first reference waveform is detected is a first point in time and a point in time when the second reflected optical signal T2 corresponding to the reset reference waveform is a second point in time.

And the detected time is referred to as the second point in time. The first point in time is the point before the second point in time. The temperature of the photodiode 300 at the first point in time is set to the first temperature and the temperature of the photodiode 300 at the second point in time is set to the second temperature. The first point in time comes before the second point in time. Also, it is assumed that a temperature of the photodiode 300 at the first point in time is a first temperature and a temperature of the photodiode 300 at the second point in time is a second temperature.

Operation (S120) of setting the waveform of the first reflected optical signal to the reference waveform will be described. At a first point in time, the photodiode 300 detects the first reflected optical signal T1. The detected first reflected optical signal T1 is stored as a waveform and set as a reference waveform. The intrusion determining unit 400 determines whether an intrusion has occurred on the basis of the reference waveform corresponding to the first reflected optical signal T1 until the reference waveform is reset after the first point in time.

The photodiode temperature measuring unit 350 measures a temperature of the photodiode 300 at a first point in time. The temperature of the photodiode 300 measured at the first point in time is designated and stored as the first temperature.

Operation (S220) of determining whether the second temperature is within the allowable range will be described. The second point in time comes after the first point in time. An interval between the first point in time and the second point in time may be changed and set by the user. The photodiode temperature measuring unit 350 measures a temperature of the photodiode 300 at the second point in time. The intrusion determining unit 400 designates the temperature of the photodiode 300 measured at the second point in time as a second temperature and stores the same.

The intrusion determining unit 400 determines whether the second temperature is within the allowable range with respect to the first temperature. Here, the allowable range is set in advance and may be changed and set by the user. The allowable range may be equal to or lower than a level at which the difference between the reflected optical signals detected due to the difference between the first temperature and the second temperature is determined as an intrusion by the intrusion determining unit.

If it is determined that the second temperature exceeds the allowable range, resetting a waveform of the second reflected optical signal T2 to the reference waveform is performed. If it is determined that the second temperature does not exceed the allowable range, the reference waveform is not reset and the intrusion determining unit 400 continues to determine whether an intrusion has occurred on the basis of the reference waveform corresponding to the first reflected optical signal T1.

Operation (S320) of resetting the waveform of the second reflected optical signal to the reference waveform will be described. The photodiode 300 detects the second reflected optical signal T2 at the second point in time. Then, the waveform of the detected second reflected optical signal T2 is reset to the reference waveform.

FIG. 6 illustrates an example in which the second temperature is higher than the first temperature by the allowable range or greater. If the second temperature is higher than the first temperature, although a reflected optical signal having the same power is generated, the photodiode 300 detects it as a smaller signal. Referring to FIG. 4, the second reflected optical signal T2 is illustrated to be smaller than the first reflected optical signal T1. Here, if the waveform of the second reflected optical signal is not reset to the reference waveform, the intrusion determining unit 400 may erroneously detect a change in the reflected optical signal, which is caused due to an increase in temperature of the photodiode 300 though, as the occurrence of an intrusion.

When the above-described operation is completed, the intrusion determining unit 400 newly resets the second point in time to the first point in time, and when the second point in time comes again on the basis of the newly set first point in time, the intrusion determining unit 400 repeats the above-described operations. Thus, erroneous detection of an intrusion due to a change in temperature of the photodiode 300 may be prevented.

Hereinafter, re-determination of an intrusion in the intrusion detecting method of the present disclosure will be described with reference to FIGS. 10 and 11.

Figure 10:
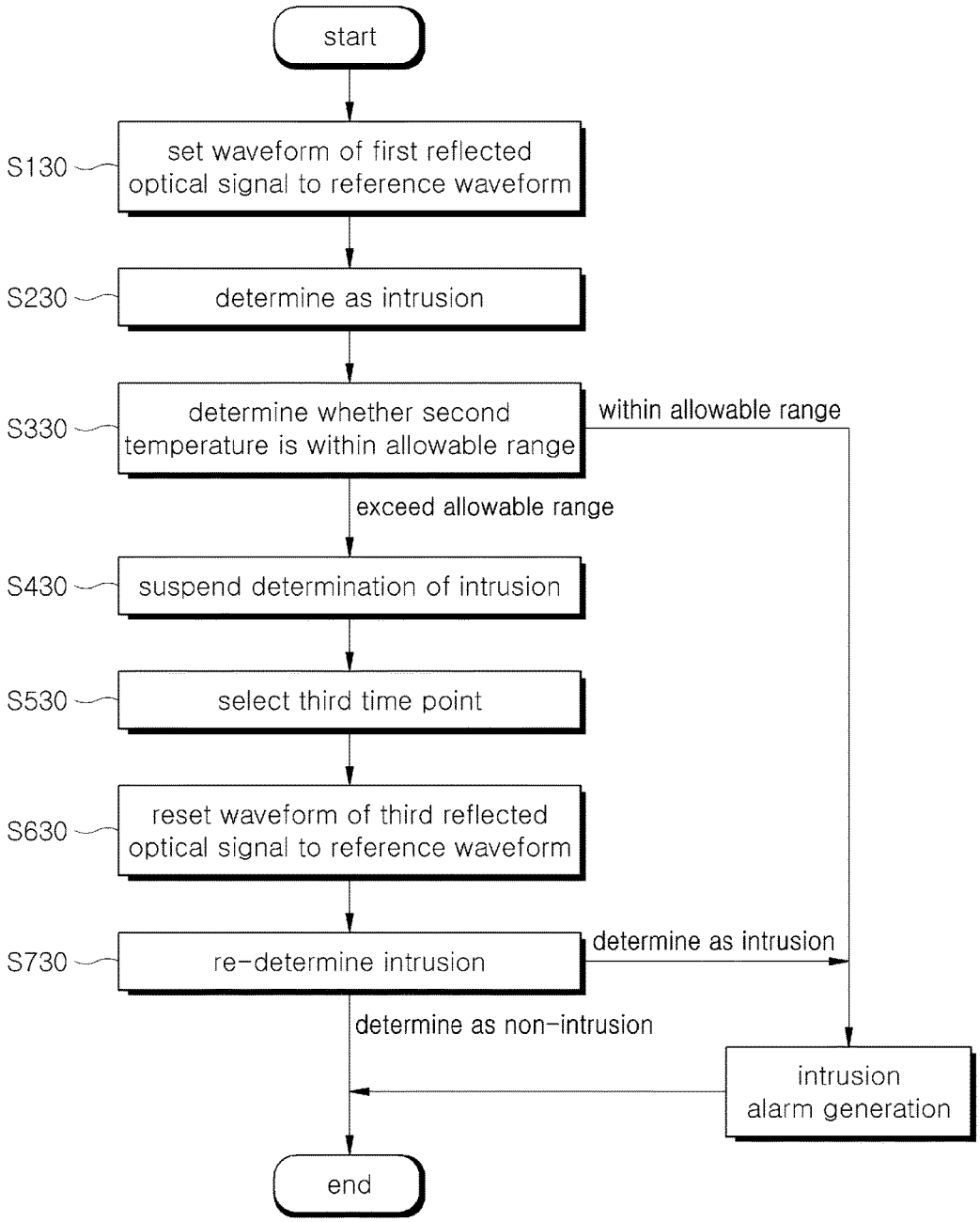
FIG. 10 is a flowchart illustrating re-determination of an intrusion.

FIG. 10 is a flowchart illustrating re-determination of an intrusion. FIG. 11 is a graph illustrating re-determination of an intrusion. Re-determination of an intrusion in consideration of a change in temperature of the photodiode 300 will be described with reference to FIGS. 10 and 11.

Hereinabove, resetting of the reference waveform according to a rapid change in temperature of the photodiode 300 has been described with reference to FIGS. 8 and 9. Re-determining of the intrusion described below is re-determining the intrusion, which has already been determined by the intrusion determining unit 400 on the basis of the change in the waveform due to the rapid change in temperature of the photodiode 300, in consideration of a change in temperature of the photodiode 300.

Referring to FIG. 10, re-determining of an intrusion according to the present disclosure includes setting a waveform of a first reflected optical signal to a reference waveform (S130), determining that an intrusion has occurred (S230), determining whether the second temperature is within the allowable range (S330), suspending the determination that an intrusion has occurred (S430), selecting a third point in time (S530), resetting a waveform of a third reflected optical signal to a reference waveform (S630), and re-determining whether an intrusion has occurred (S730).

For the purposes of description, it is assumed that a point in time when the first reflected optical signal T1 corresponding to the first reference waveform is detected is a first point in time, a point in time when the second reflected optical signal T2 determined as an intrusion by the intrusion determining unit 400 is detected is a second point in time, and a pint in time when the third reflected optical signal T3 that may correspond to a reference waveform reset to re-determine whether an intrusion has occurred according to the second reflected optical signal T2 is a third point in time. Accordingly, the first point in time is the most preceding point in time, the third point in comes after the first point in time, and the second point in time comes after the third point in time.

Also, it is assumed that a temperature of the photodiode 300 at the first point in time is a first temperature, a temperature of the photodiode 300 at the second point in time is a second temperature, and a temperature of the photodiode 300 at the third point in time is a third temperature.

Operation (S130) of setting the waveform of the first reflected optical signal to a reference waveform will be described. The photodiode 300 detects the first reflected optical signal T1 at the first point in time. The detected first reflected optical signal T1 is stored as a waveform and set as a reference waveform. The intrusion determining unit 400 determines whether an intrusion has occurred on the basis of the reference waveform corresponding to the first reflected optical signal T1 until the reference waveform is reset after the first point in time.

The photodiode temperature measuring unit 350 measures a temperature of the photodiode 300 at the first point in time. The photodiode temperature measuring unit 350 designates the temperature of the photodiode 300 measured at the first point in time as a first temperature and stores the same.

Operation (S230) of determining that an intrusion has occurred will be described. The photodiode 300 detects the first reflected optical signal T1 at the second point in time. The intrusion determining unit 400 compares a waveform of the second reflected optical signal T2 with the set reference waveform to determine whether an intrusion has occurred, and determines that an intrusion has occurred.

The second point in time comes after the first point in time. An interval between the first point in time and the second point in time may be changed and set by the user.

Figure 11:
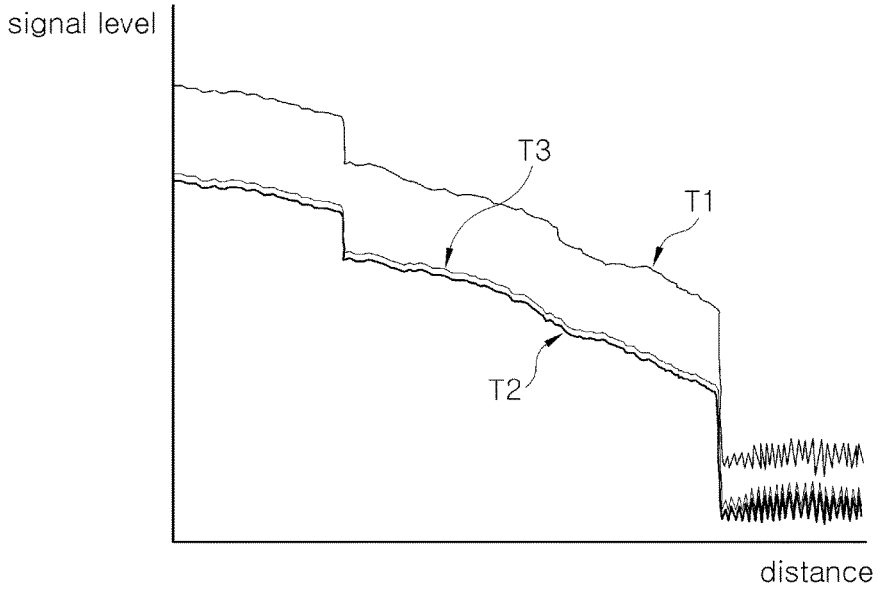
FIG. 11 is a graph illustrating re-determination of an intrusion.

In FIG. 11, an example in which the second temperature at the second point in time is higher than the first temperature by an allowable range or greater is illustrated. In case where the second temperature is higher than the first temperature, although a reflected optical signal having the same power is generated, power of the reflected optical signal detected by the photodiode 300 is weakened. Referring to FIG. 11, the second reflected optical signal T2 is illustrated to be smaller than the first reflected optical signal T1. As the second reflected optical signal T2 smaller than the first reflected optical signal T1 exceeds the reference for determining an intrusion, the intrusion determining unit 400 determines that an intrusion has occurred. Since the determination is based on an increase in temperature of the photodiode 300 and an intrusion has not actually occurred in the optical fiber line 100, it corresponds to erroneous detection.

Operation (S350) of determining whether the second temperature is within the allowable range will be described. The photodiode temperature measuring unit 350 measures a temperature of the photodiode 300 at the second point in time, and designates the temperature of the photodiode 300 measured at the second point in time as a second temperature and stores the same.

The intrusion detecting system determines whether the second temperature is within the allowable range on the basis of the first temperature. Here, the allowable range is set in advance and may be changed to be set by the user. The allowable range may be equal to or lower than a level at which the difference between the reflected optical signals caused by the difference between the first temperature and the second temperature is determined as an intrusion by the intrusion determining unit.

If it is determined that the second temperature exceeds the allowable range, the intrusion detecting system suspends the determination that an intrusion has occurred (S430), selects a third point in time (S530), resets a waveform of the third reflected optical signal to a reference waveform (S630), and re-determines whether an intrusion has occurred (S730), and the like. If, however, it is determined that the second temperature does not exceed the allowable range, the intrusion determining unit 400 confirms the determination that an intrusion has occurred, and produces intrusion alarm, or the like.

Operation (S430) of suspending the determination that an intrusion has occurred will be described. If it is determined that the second temperature exceeds the allowable range, the intrusion determining unit 400 suspends the determination that an intrusion has occurred. Accordingly, follow-up measures such as generation of an intrusion alarm, or the like, are not taken but suspended.

Operation (S530) of selecting the third point in time will be described. The third point in time is a point in time when the third reflected optical signal T3, which is a new reference waveform, is detected in resetting the reference waveform. The third point in time may be a previous point within a predetermined range from the second point in time. The predetermined range may be changed and set by the user. The third point in time may be closer to the second point in time than the first point in time.

The photodiode temperature measuring unit 250 measures a temperature of the laser diode 200 at the third point in time. The temperature of the laser diode 200 measured at the third point in time is designated and stored as a third temperature. The third temperature must be within the allowable range on the basis of the second temperature. The intrusion detecting system checks at least one point in time that satisfies such a condition from within a predetermined range starting from the second point in time and selects an appropriate third point in time. When the appropriate third point in time is selected, resetting a waveform of the third reflected optical signal T3 to a reference waveform is performed.

Operation (S630) of resetting the waveform of the third reflected optical signal T3 to the reference waveform will be described. The photodiode 300 detects the third reflected optical signal T3 at the third point in time. The third reflected optical signal T3 is reset to the reference waveform.

In FIG. 11, an example in which the third temperature is higher than the first temperature but lower than the second temperature is illustrated. The third temperature is a temperature having a smaller difference from the second temperature than the first temperature. In this case, the third reflected optical signal T3 is generated closer to the second reflected optical signal T2 than the first reflected optical signal T1. Accordingly, resetting the waveform of the third reflected optical signal to the reference waveform (S630) corresponds to resetting the reference waveform to a waveform closer to the second reflected optical signal T2.

Operation (S730) of re-determining whether an intrusion has occurred will be described. The intrusion determining unit 400 compares a waveform of the second reflected optical signal T2 with the reset reference waveform to re-determine whether an intrusion has occurred. Since the newly set reference waveform reflects correction of the error due to the rapid change in the temperature of the photodiode 300, and erroneous detection of an intrusion due to the error may be prevented.

If it is determined that the waveform of the second reflected optical signal T2 still indicates an intrusion as a result of the re-determination in operation S730, the intrusion determining unit 400 cancels the previously suspended determination. Accordingly, an intrusion alarm due to an intrusion is produced. Meanwhile, if it is determined that the waveform of the second reflected optical signal T2 indicates non-intrusion as a result of re-determining whether an intrusion has occurred, the intrusion determining unit 400 cancels the previous determination that an intrusion has occurred.

If the resetting described above is not performed, the determination by the intrusion determining unit 400 that an intrusion has occurred is confirmed and an intrusion alarm is produced. Here, however, such an intrusion may not be an intrusion which actually occurred but may be an intrusion due to an increase in temperature of the photodiode 300. Thus, such erroneous detection may be prevented by the intrusion detecting method of the present disclosure.

Through the reference waveform resetting and re-evaluation method, an erroneous determination that an intrusion occurred due to a rapid change in temperature of the photodiode 300, which was already made by the intrusion determining unit 400, may be selected to correct erroneous detection thereof.

In the above, the intrusion detecting method for preventing erroneous detection of an intrusion due to a change in temperature of the laser diode 200 has been described with reference to FIGS. 1 to 6. Also, the intrusion detecting method for preventing erroneous detection of an intrusion due to a change in temperature of the photodiode 300 has been described with reference to FIGS. 7 to 11. These two methods have separately been described, but in some cases, changes in temperature of the laser diode 200 and the photodiode 300 may be measured together and erroneous detection of an intrusion may be prevented by reflecting measurement results.

Hereinafter, a method for detecting an intrusion by reflecting a change in environment will be described with reference to FIGS. 12 to 16.

First, an intrusion detecting system to which an intrusion detecting method according to another embodiment of the present disclosure is applied will be described with reference to FIG. 12.

Figure 12:
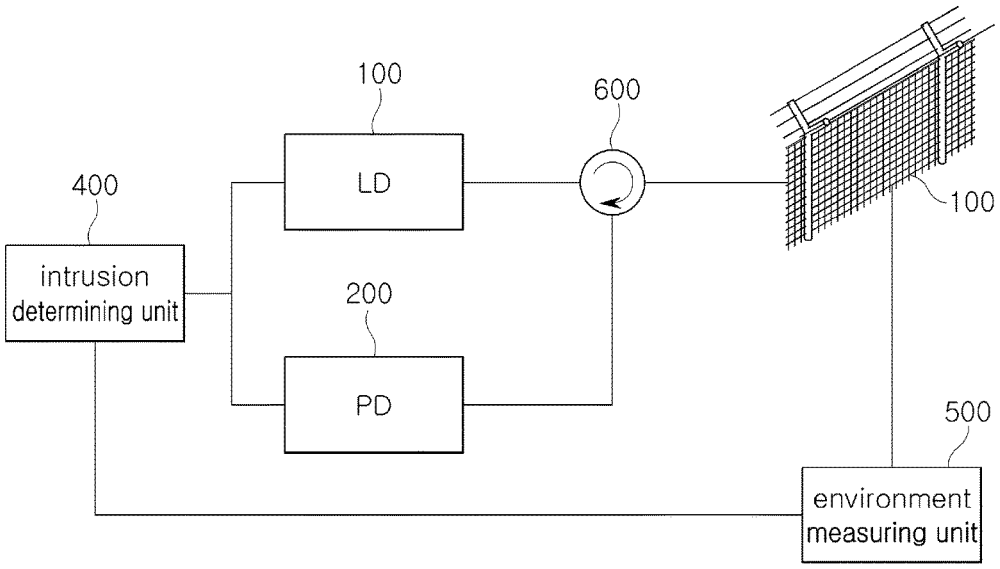
FIG. 12 is a block diagram of an intrusion detecting system to which an intrusion detecting method according to another embodiment of the present disclosure is applied.

FIG. 12 is a block diagram of an intrusion detecting system to which an intrusion detecting method according to another embodiment of the present disclosure is applied. Hereinafter, the intrusion detecting system described hereinafter is partly the same as the intrusion detecting system described above with reference to FIGS. 1 and 2. Thus, for the purposes of description, a difference from the above-described intrusion detecting system will be largely described.

Referring to FIG. 12, the intrusion detecting system includes the optical fiber line 100, the laser diode 200, the photodiode 300, the intrusion determining unit 400, and an environment measuring unit 500.

The environment measuring unit 500 is a part for measuring an environmental variable that affect the optical fiber line 100. The environment measuring unit 500 may be installed near a spot where the optical fiber line 100 is installed. Since the optical fiber line 100 is installed in a relatively large area, a plurality of environment measuring unit s 500 may be installed at different locations.

The environment measuring unit 500 may measure various environmental variables affecting the optical fiber line 100. The environment measuring unit 500 may measure, for example, any one of a wind direction, a wind speed, a temperature, and illumination. To this end, the environment measuring unit 500 may include any one of a weather vane, an anemometer, a thermometer, and an illuminometer.

When an environment around the optical fiber line 100 is suddenly changed, a reflected optical signal may be rapidly changed. For example, when the optical path 100 is blown, a shape of the optical path 100 may be deformed and bent. Also, if a temperature of the optical fiber line 100 drops sharply, the optical fiber line 100 and a jacket portion surrounding the optical fiber line 100 may shrink to be bent. This bending may increase the loss of the optical signal passing through the optical fiber line 100 at the portion where bending occurs. If the intrusion determining unit 400 recognizes a change in the reflected optical signal due to such a loss as an intrusion, it corresponds to erroneous detection.

The environmental variables refer to quantitatively represented various factors measured by the environment measuring unit 500. When the environment measuring unit 500 measures a plurality of factors, the environmental variables may be data reflecting a plurality of factors in a complex manner. In this case, the environmental variables may be determined so as to be numerically related to an influence on the optical fiber line 100. For example, if an environmental variable is increased, it may be determined to have a relation that loss of the optical fiber line 100 is increased.

An intrusion detecting method capable of preventing erroneous detection due to an environmental change will be described in more detail hereinafter.

Hereinafter, resetting of a reference waveform in the intrusion detecting method of the present disclosure will be described with reference to FIGS. 13 and 14.

Figure 13:
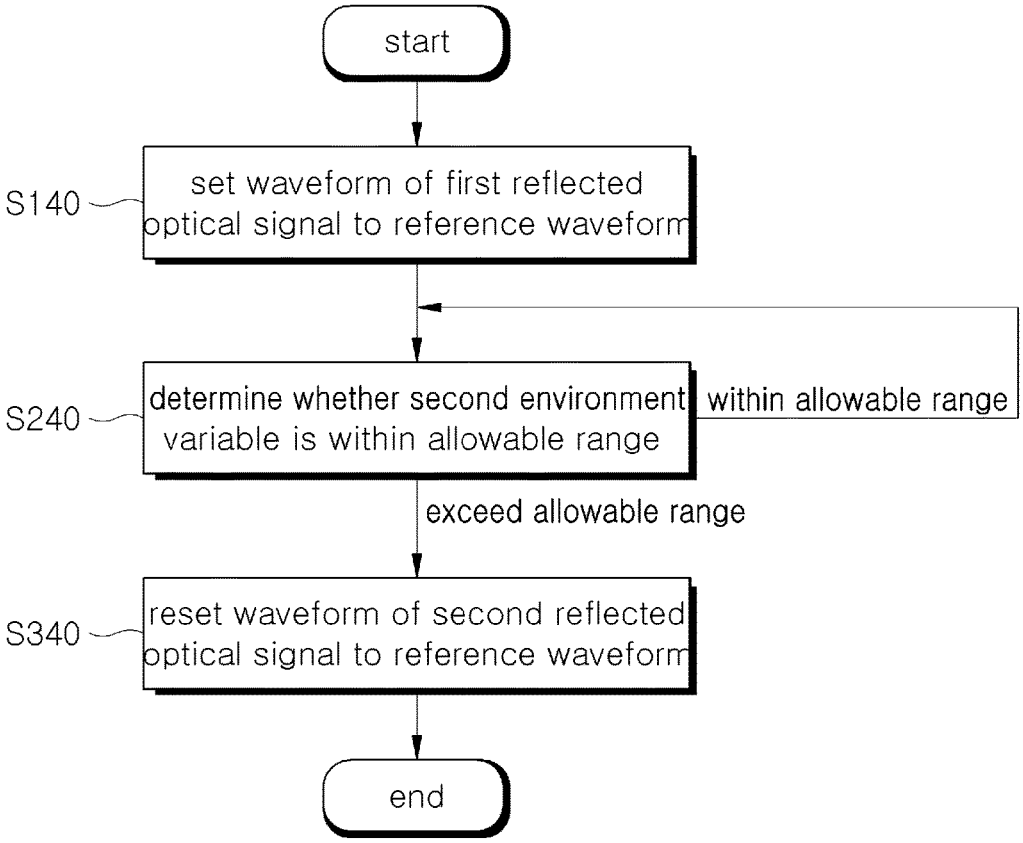
FIG. 13 is a flowchart illustrating resetting of a reference waveform.

FIG. 13 is a flowchart illustrating resetting of a reference waveform. FIG. 14 is a graph illustrating resetting of a reference waveform. Resetting of a reference waveform according to environmental variables that affect the optical fiber line 100 will be described with reference to FIGS. 13 and 14.

Resetting of a reference waveform to be described below is intended to prevent erroneous detection of an intrusion according to environmental variables that affect the optical fiber line 100. If an environmental variable that affects the optical fiber line 100 is changed suddenly, the reflected optical signal may also be changed rapidly. Thus, the reflected optical signal may be changed rapidly although no intrusion, or the like, occurs in the optical fiber line 100. In this case, the intrusion determining unit 400 may erroneously determine the change in the reflected optical signal due to the change in the environmental variable that affects the optical fiber line 100, as an intrusion.

The purpose of resetting a reference waveform to be described below is to prevent such an erroneous detection. To this end, an environmental variable at the time of detecting the reflected optical signal selected as the reference waveform and an environmental variable at the present time are measured. The environmental variables are measured in the environment measuring unit 500.

Referring to FIG. 13, resetting the reference waveform of the present disclosure may include setting a waveform of a first reflected optical signal to a reference waveform (S140), determining whether a second environmental variable is within an allowable range (S240), and resetting a waveform of the second reflected optical signal to a reference waveform (S340).

For the purposes of description, it is assumed that a point in time when the first reflected optical signal T1 corresponding to a first reference waveform is detected is a first point in time, and the second reflected optical signal T2 corresponding to a reset reference waveform is a second point in time. The first point in time comes before the second point in time. Also, it is assumed that an environmental variable at the first point in time is a first environmental variable and an environmental variable at the second point in time is a second environmental variable.

Operation (S140) of setting the waveform of the first reflected optical signal T1 to the reference waveform will be described. The photodiode 300 detects the first reflected optical signal T1 at the first point in time. The detected first reflected optical signal T1 is stored as a waveform and set as a reference waveform. The intrusion determining unit 400 determines whether an intrusion has occurred on the basis of the reference waveform corresponding to the first reflected optical signal T1 until the reference waveform is reset after the first point in time.

The environment measuring unit 500 measures an environmental variable that affects the optical fiber line 100 at a first point in time. The environment measuring unit 500 designates the environmental variable measured at the first point in time as a first environmental variable and stores the same.

Operation (S240) of determining whether the second environmental variable is within the allowable range (S240) will be described. The second point in time comes after the first point in time. An interval between the first point in time and the second point in time may be changed to be set by the user. The environment measuring unit 500 measures an environmental variable that affects the optical fiber line 100 at the second point in time. The environment measuring unit 500 designates the environmental variable measured at the second point in time as the second environmental variable and stores the same.

The intrusion determining unit 400 determines whether the second environmental variable is within the allowable range on the basis of the first environmental variable. Here, the allowable range is set in advance and may be changed to be set by the user. The allowable range may be equal to or lower than a level at which a difference between the reflected optical signals detected due to the difference between the first environmental variable and the second environmental variable is determined as an intrusion by the intrusion detecting unit.

If it is determined that the second environmental variable exceeds the allowable range, resetting the waveform of the second reflected optical signal T2 to the reference waveform is performed. If it is determined that the second environmental variable does not exceed the allowable range, the reference waveform is not reset and the intrusion determining unit 400 continues to determine whether an intrusion has occurred on the basis of the reference waveform corresponding to the first reflected optical signal T1.

Operation (S340) of resetting the waveform of the second reflected optical signal to a reference waveform will be described. The photodiode 300 detects the second reflected optical signal T2 at the second point in time. The intrusion determining unit 400 resets the waveform of the detected second reflected optical signal to the reference waveform.

Figure 14:
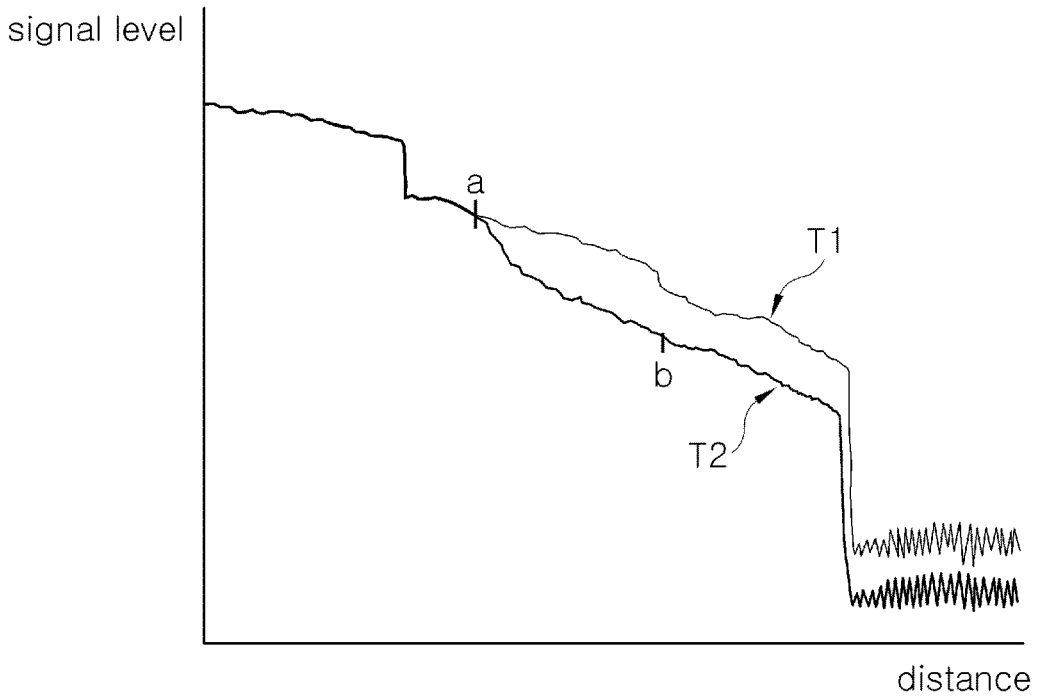
FIG. 14 is a graph illustrating resetting of a reference waveform.

In FIG. 14, an example in which loss of an optical signal in the optical fiber line 100 is larger due to a second environmental variable is illustrated. Specifically, in FIG. 14, the optical fiber line 100 is severely shrunk due to the stronger wind or a temperature drop in a section between a and b, so that severe bending of the optical fiber line 100 may occur to increase larger loss of the optical signal. Referring to FIG. 14, it is illustrated that the second reflected optical signal T2 is smaller than the first reflected optical signal T1. In this case, if the waveform of the second reflected optical signal is not reset to the reference waveform, the intrusion determining unit 400 may erroneously detect the change in the reflected optical signal, which is caused due to the change in the environment though, as the occurrence of an intrusion.

When the above-described operation is completed, the intrusion determining unit 400 newly resets the second point in time to the first point in time, and when the second point in time comes again on the basis of the newly set first point in time, the intrusion determining unit 400 repeats the above-described operations. Thus, erroneous detection of an intrusion due to a change in temperature of the photodiode 300 may be prevented.

Hereinafter, re-determination of an intrusion in the intrusion detecting method of the present disclosure will be described with reference to FIGS. 15 and 16.

Figure 15:
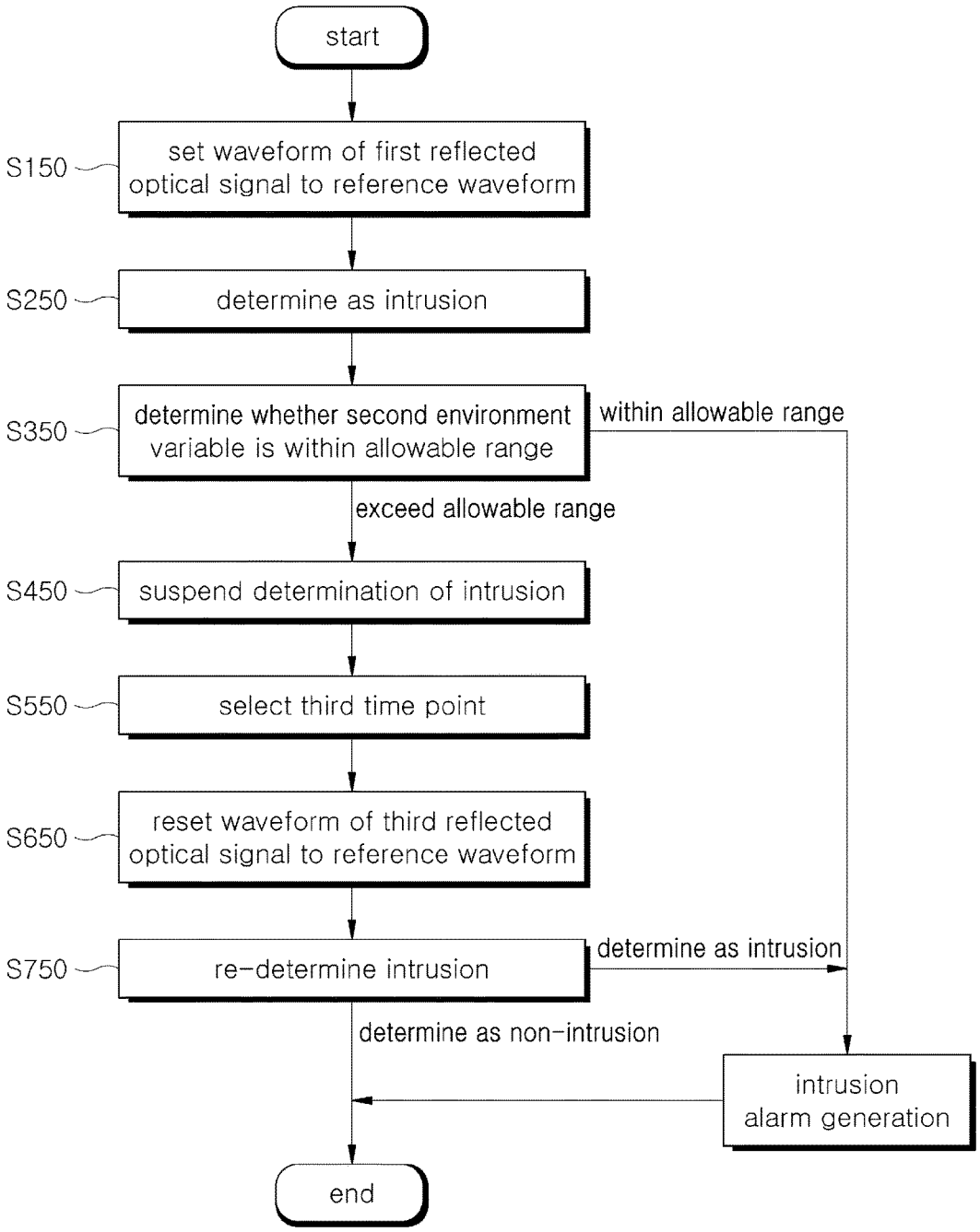
FIG. 15 is a flowchart illustrating re-determination of an intrusion.

FIG. 15 is a flowchart illustrating re-determination of an intrusion. FIG. 16 is a graph illustrating re-determination of an intrusion. Re-determination of an intrusion in consideration of a change in an environmental variable will be described with reference to FIGS. 15 and 16.

Hereinabove, resetting of the reference waveform according to a rapid change in an environmental variable has been described with reference to FIGS. 13 and 14. Re-determining of the intrusion described below is re-determining the intrusion, which has already been determined by the intrusion determining unit 400 on the basis of the change in the waveform due to the rapid change in the environmental variable, in consideration of a change in temperature of the photodiode 300.

Referring to FIG. 15, re-determining of an intrusion according to the present disclosure includes setting a waveform of the first reflected optical signal to a reference waveform (S510), determining that an intrusion has occurred (S250), determining whether the second environmental variable is within the allowable range (S350), suspending the determination that an intrusion has occurred (S450), selecting a third point in time (S550), resetting a waveform of the third reflected optical signal to a reference waveform (S650), and re-determining whether an intrusion has occurred (S750).

For the purposes of description, it is assumed that a point in time when the first reflected optical signal T1 corresponding to the first reference waveform is detected is a first point in time, a point in time when the second reflected optical signal T2 determined by the intrusion determining unit as an intrusion is sensed is a second point in time, and a point in time when the third reflected optical signal T3 corresponding to the reference waveform reset to re-determine whether an intrusion has occurred according to the second reflected optical signal T2 is sensed is a third point in time. Accordingly, the first point in time is the most preceding point in time, the third point in time comes after the first point in time, and the second point in time comes after the third point in time.

Also, it is assumed that an environmental variable at the first point in time is a first environmental variable, an environment point at the second point in time is a second environmental variable, and an environmental variable at the third point in time is a third environmental variable.

Operation (S150) of setting the waveform of the first reflected optical signal to the reference waveform will be described. The photodiode 300 detects the first reflected optical signal T1 at the first point in time. The detected first reflected optical signal T1 is stored as a waveform and set as a reference waveform. The intrusion determining unit 400 determines whether an intrusion has occurred on the basis of the reference waveform corresponding to the first reflected optical signal T1 until the reference waveform is reset after the first point in time.

The environment measuring unit 500 measures an environmental variable at the first point in time. The environment measuring unit 500 designates the environmental variable measured at the first point in time as the first environmental variable and stores the same.

Operation (S250) of determining that an intrusion has occurred will be described. The photodiode 300 detects the first reflected optical signal T1 at the second point in time. The intrusion determining unit 400 compares the waveform of the second reflected optical signal T2 with the set reference waveform to determine whether an intrusion has occurred, and determines that an intrusion has occurred.

The second point in time comes after the first point in time. An interval between the first point in time and the second point in time may be changed and set by the user.

Figure 16:
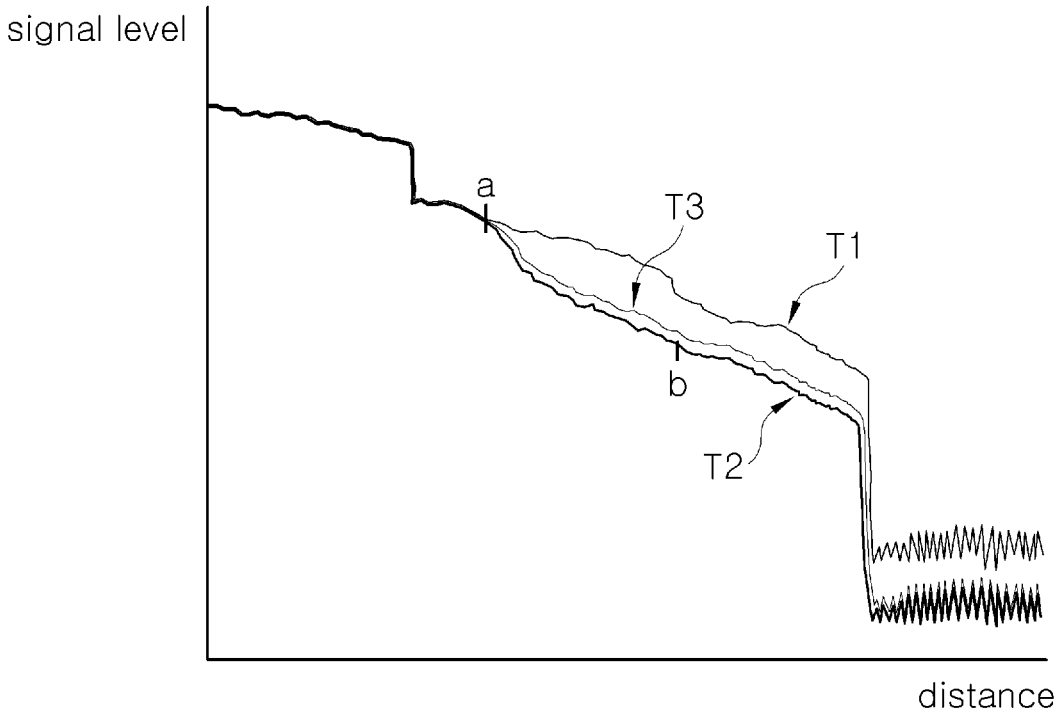
FIG. 16 is a graph illustrating re-determination of an intrusion.

In FIG. 16, an example in which loss of an optical signal in the optical fiber line 100 is larger due to a second environmental variable is illustrated. Specifically, in FIG. 16, the optical fiber line 100 is severely shrunk due to the stronger wind or a temperature drop in a section between a and b, so that severe bending of the optical fiber line 100 may occur to increase larger loss of the optical signal. Referring to FIG. 16, it is illustrated that the second reflected optical signal T2 is smaller than the first reflected optical signal T1. In this case, as the second reflected optical signal T2 smaller than the first reflected optical signal T1 exceeds the reference for determining an intrusion, and thus, the intrusion determining unit 400 determines that an intrusion has occurred. Such a determination is based on an change in the environment and corresponds to erroneous detection because an intrusion does not occur actually.

Operation (S350) of determining whether the second environmental variable is within the allowable range will be described. The environment measuring unit 500 measures an environmental variable at the second point in time. The environment measuring unit 500 designates the environmental variable measured at the second point in time as the second environmental variable and stores the same.

The intrusion determining unit 400 determines whether the second environmental variable is within the allowable range on the basis of the first environmental variable. Here, the allowable range is set in advance and may be changed and set by the user. Here, the allowable range is equal to or less than a level at which the difference between the reflected optical signals caused by the difference between the first environmental variable and the second environmental variable is determined as an intrusion by the intrusion detection unit.

If it is determined that the second environmental variable exceeds the allowable range, suspending the determination of the intrusion, selecting a third point in time, resetting the waveform of the third reflected optical signal T3 to a reference waveform, and re-determining whether an intrusion has occurred, and the like, are performed. If, however, it is determined that the second environmental variable does not exceed the allowable range, the previously determined intrusion is confirmed and an intrusion alarm due to the intrusion is produced.

Operation (S450) of suspending the determination that an intrusion has occurred will be described. If it is determined that the second environmental variable exceeds the allowable range, the intrusion determining unit 400 will suspends the determination that an intrusion has occurred. Thus, follow-up measures such as an intrusion alarm, or the like, are not taken and are suspended.

Operation (S550) of selecting the third point in time will be described. The third point in time is a point in time when an input optical signal inducing the third reflected optical signal T3, which becomes a new reference waveform in resetting the reference waveform, is input. The third point in time may be a previous point within a predetermined range from the second point in time. The predetermined range may be changed and set by the user. The third point in time may be closer to the second point in time than the first point in time.

The environment measuring unit 500 measures environmental variables at a third point in time. The environment measuring unit 500 designates the environmental variable measured at the third point in time as the third environmental variable and stores the same. The third environmental variable must be within the allowable range on the basis of the second environmental variable. The intrusion detecting system checks at least one point that satisfies such a condition from within a predetermined range starting from the second point in time and selects an appropriate third point in time. When the appropriate third point in time is selected, resetting of a waveform of the third reflected optical signal T3 to the reference waveform is performed.

Operation (S650) of resetting the waveform of the third reflected optical signal T3 to the reference waveform will be described. The photodiode 300 detects the third reflected optical signal T3 at the third point in time. Then, the third reflected optical signal T3 is reset to the reference waveform.

In FIG. 16, an example in which the third environmental variable is between the first environmental variable and the second environmental variable is illustrated. The third environmental variable has a smaller difference from the second environmental variable than the first environmental variable. In this case, the third reflected optical signal T3 is generated closer to the second reflected optical signal T2 than to the first reflected optical signal T1. Accordingly, the resetting of the waveform of the third reflected optical signal to the reference waveform corresponds to resetting of the reference waveform to a waveform closer to the second reflected optical signal T2.

Operation (S750) of re-determining whether an intrusion has occurred will be described. The intrusion determining unit 400 compares the waveform of the second reflected optical signal T2 with the reset reference waveform to re-determine whether an intrusion has occurred. Since the newly set reference waveform reflects correction of the error due to the rapid change in the environmental variable, erroneous detection of an intrusion due to the error may be prevented.

If it is determined that the waveform of the second reflected optical signal T2 still indicates an intrusion as a result of the re-determination in operation S750, the intrusion determining unit 400 cancels the previously suspended determination. Accordingly, an intrusion alarm due to an intrusion is produced. Meanwhile, if it is determined that the waveform of the second reflected optical signal T2 indicates non-intrusion as a result of re-determining whether an intrusion has occurred, the intrusion determining unit 400 cancels the previous determination that an intrusion has occurred.

If the resetting described above is not performed, the determination by the intrusion determining unit 400 that an intrusion has occurred is confirmed and an intrusion alarm is produced. Here, however, such an intrusion may not be an intrusion which actually occurred but may be an intrusion due to a change in an environment. Thus, such erroneous detection may be prevented by the intrusion detecting method of the present disclosure.

Through the reference waveform resetting and re-evaluation method, an erroneous determination that an intrusion occurred due to a rapid change in the environmental variable, which was already made by the intrusion determining unit 400, may be selected to correct erroneous detection thereof.

Embodiments of the intrusion detecting method of the present disclosure have been described. The present disclosure is not limited to the above-described embodiments and the accompanying drawings and various modifications and changes may be made in view of the person skilled in the art to which the present disclosure pertains. Therefore, the scope of the present disclosure should be determined by the scope of the appended claims and equivalents thereof.

What is claimed is:

1. An intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a laser diode temperature measuring unit measuring a temperature of the laser diode, the intrusion detecting method comprising:

designating, by the intrusion determining unit, a temperature of the laser diode at a first point in time as a first temperature and setting, to a reference waveform, a waveform of a first reflected optical signal caused by an input optical signal input by the laser diode at the first point in time;

designating, by the intrusion determining unit, a temperature of the laser diode at a second point in time after the first point in time as a second temperature and determining whether the second temperature is within an allowable range with respect to the first temperature; and when it is determined that the second temperature exceeds the allowable range, resetting, by the intrusion determining unit, to the reference waveform, a waveform of a second reflected optical signal caused by an input optical signal input by the laser diode at the second point in time.

2. An intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a laser diode temperature measuring unit measuring a temperature of the laser diode, the intrusion detecting method comprising:

designating, by the intrusion determining unit, a temperature of the laser diode at a first point in time as a first temperature and setting, to a reference waveform, a waveform of a first reflected optical signal caused by an input optical signal input by the laser diode at the first point in time;

comparing, by the intrusion determining unit, a waveform of a second reflected optical signal caused by the input optical signal input by the laser diode at a second point in time after the first point in time with the set reference waveform and determining that an intrusion has occurred;

designating, by the intrusion determining unit, a temperature of the laser diode at the second point in time as a second temperature and determining whether the second temperature is within an allowable range with respect to the first temperature;

when it is determined that the second temperature exceeds the allowable range, suspending, by the intrusion determining unit, the determination that an intrusion has occurred;

selecting, by the intrusion determining unit, a third point in time which comes after the first point in time and comes before the second point in time and at which the temperature of the laser diode is within the allowable range with respect to the second temperature;

resetting, by the intrusion determining unit, to a reference waveform, a waveform of a third reflected optical signal caused by the input optical signal input by the laser diode at the third point in time;

comparing, by the intrusion determining unit, a waveform of the second reflected optical signal with the reset reference waveform to re-determine whether an intrusion has occurred; and when it is determined that an intrusion has occurred as a result of the re-determination, canceling, by the intrusion determining unit, the suspended determination, and when it is determined that an intrusion has not occurred as a result of the re-determination, canceling, by the intrusion determining unit, the determination that an intrusion has occurred.

3. An intrusion detecting method using an intrusion detecting system which includes an optical fiber line installed in an area in which intrusion is to be detected, a laser diode inputting an optical signal to the optical fiber line, a photodiode detecting a reflected optical signal when the optical signal is reflected from the optical fiber line, an intrusion determining unit comparing a waveform of the reflected optical signal detected by the photodiode with a set reference waveform to determine whether an intrusion has occurred, and a photodiode temperature measuring unit measuring a temperature of the photodiode, wherein the photodiode is an avalanche photodiode, the intrusion detecting method comprising:

designating, by the intrusion determining unit, a temperature of the photodiode at a first point in time as a first temperature and setting, to a reference waveform, a waveform of a first reflected optical signal detected by the photodiode at the first point in time;

designating, by the intrusion determining unit, a temperature of the photodiode at a second point in time after the first point in time as a second temperature and determining whether the second temperature is within an allowable range with respect to the first temperature; and when it is determined that the second temperature exceeds the allowable range, resetting, by the intrusion determining unit, to the reference waveform, a waveform of a second reflected optical signal detected by the photodiode at the second point in time.

* * * * *